US008920161B2

(12) United States Patent
Moetteli et al.

(10) Patent No.: US 8,920,161 B2
(45) Date of Patent: Dec. 30, 2014

(54) APPARATUS AND METHOD FOR EXTINGUISHING A FLAME UPON DISTURBING THE APPARATUS

(76) Inventors: John Brent Moetteli, Arbon (CH); Robin Saegewitz, Widnau (CH)

( * ) Notice: Subject to any disclaimer, the term of this patent is extended or adjusted under 35 U.S.C. 154(b) by 390 days.

(21) Appl. No.: 13/404,020

(22) Filed: Feb. 24, 2012

(65) Prior Publication Data

US 2012/0225391 A1 Sep. 6, 2012

Related U.S. Application Data

(60) Provisional application No. 61/447,725, filed on Mar. 1, 2011.

(51) Int. Cl.

| | |
|---|---|
| ***F23D 3/16*** | (2006.01) |
| ***F23M 9/00*** | (2006.01) |
| ***F23C 7/00*** | (2006.01) |
| ***C11C 5/00*** | (2006.01) |
| ***F23D 3/24*** | (2006.01) |
| ***F23D 5/04*** | (2006.01) |
| *F21V 35/00* | (2006.01) |

(52) U.S. Cl.

CPC ..... *F23D 3/16* (2013.01); *F23M 9/003* (2013.01); *F23D 2700/001* (2013.01); *F23C 7/002* (2013.01); *C11C 5/008* (2013.01); *F23D 3/24* (2013.01); *F21V 35/00* (2013.01); *C11C 5/006* (2013.01); *F23D 5/04* (2013.01)

USPC ..... 431/289; 431/291; 126/519; 126/521

(58) Field of Classification Search

USPC ..... 431/252, 8, 9, 289, 291, 297, 126; 126/519, 521, 524

See application file for complete search history.

(56) References Cited

U.S. PATENT DOCUMENTS 2,254,664 A 9/1941 Quinlan
3,456,105 A * 7/1969 Bartlett ..... 362/314

(Continued)

FOREIGN PATENT DOCUMENTS

DE 20 2007 018 478 10/2008
EP 2 098 781 9/2009

(Continued)

OTHER PUBLICATIONS

Partial European Search Report, Application No. 12001200.0, Jun. 21, 2012.

(Continued)

*Primary Examiner* — Alfred Basichas
(74) *Attorney, Agent, or Firm* — Da Vinci Partners LLC; John Moetteli

(57) ABSTRACT

An apparatus is provided for containing a heat source (36) in a chamber (16) having a chimney-section (22). The apparatus has a gas inlet opening (24, 26, 30) and a gas outlet opening (32) formed in the chimney-section (22). The gas inlet opening (24, 26, 30) and the heat source are located in a lower area (12, 20') of the chamber (16) and the gas outlet opening (32) is located in an upper region (14) of the chamber (16) so that, when a heat source is placed in the chamber (16), an ascending gas flow may be generated in the chamber (16). Inflowing gas into the chamber flows therethrough into the lower area (12, 20') of the chamber (16) and then is drawn upwardly by a draw of the ascending gas flow and then though the gas outlet opening (32). The apparatus includes a subassembly (27). The chimney-section (22) is attached to the subassembly (27) so that lateral tilting of the chimney-section (22) causes motion of the subassembly (27) relative to the wick (307). This extinguishes the flame if the wick was burning.

13 Claims, 17 Drawing Sheets

(56) References Cited

U.S. PATENT DOCUMENTS

| | | | | |
|---|---|---|---|---|
| 4,926,298 | A | 5/1990 | Zimmerman | |
| 5,055,031 | A | 10/1991 | Werner | |
| 5,688,040 | A | 11/1997 | Klees | |
| 6,029,650 | A | 2/2000 | Treants | |
| 6,171,103 | B1 | 1/2001 | Orlandi | |
| 6,482,365 | B1 * | 11/2002 | Soller | 422/126 |
| 7,090,369 | B1 | 8/2006 | Jordan | |
| 2002/0048739 | A1 | 4/2002 | Chu | |
| 2004/0175287 | A1 | 9/2004 | Nakatsu et al. | |
| 2004/0261780 | A1 | 12/2004 | Frink et al. | |
| 2006/0275721 | A1 | 12/2006 | Starr et al. | |
| 2007/0003895 | A1 | 1/2007 | Conover | |
| 2010/0104993 | A1 * | 4/2010 | Ryser | 431/252 |
| 2012/0006316 | A1 * | 1/2012 | Shimek et al. | 126/519 |

FOREIGN PATENT DOCUMENTS

| | | |
|---|---|---|
| EP | 2 172 705 | 4/2010 |
| GB | 831712 | 3/1960 |
| WO | WO 2007/012037 | 1/2007 |
| WO | WO 2008/112379 | 9/2008 |

OTHER PUBLICATIONS

Screen prints of websites, Dec. 17, 2009.

Rietbrock et al., Wirbel-Strömungs-Kraftwerk, Kölner Innovationspreis 2002.

* cited by examiner

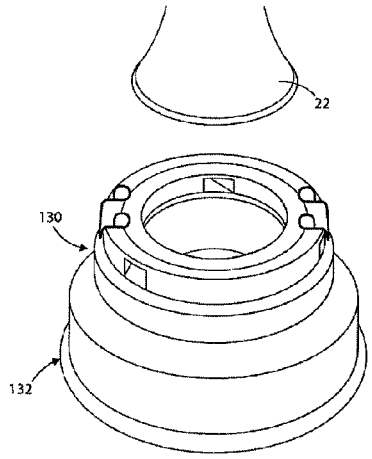
FIG. 10
FIG. 13A
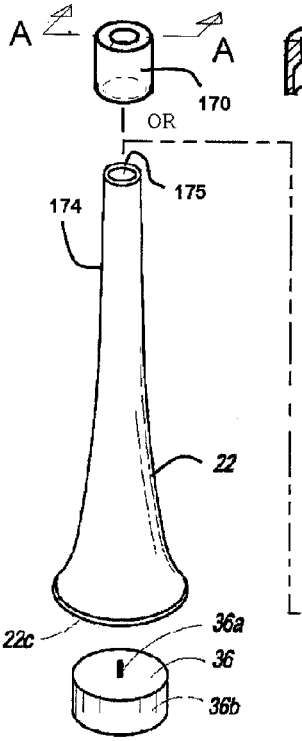
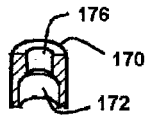
FIG. 13B
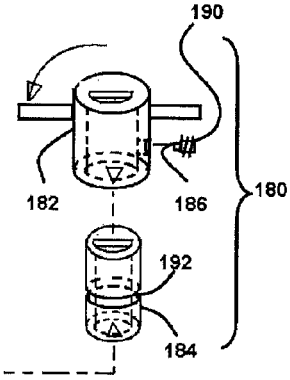
FIG. 14
FIG. 11
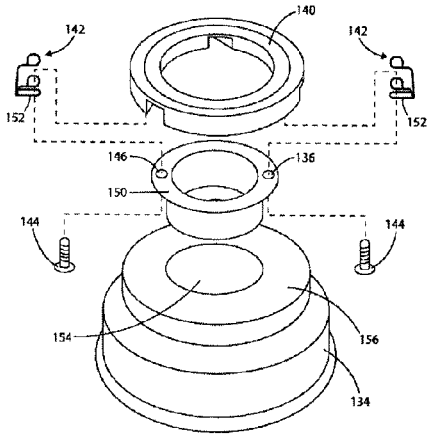

Section E-E

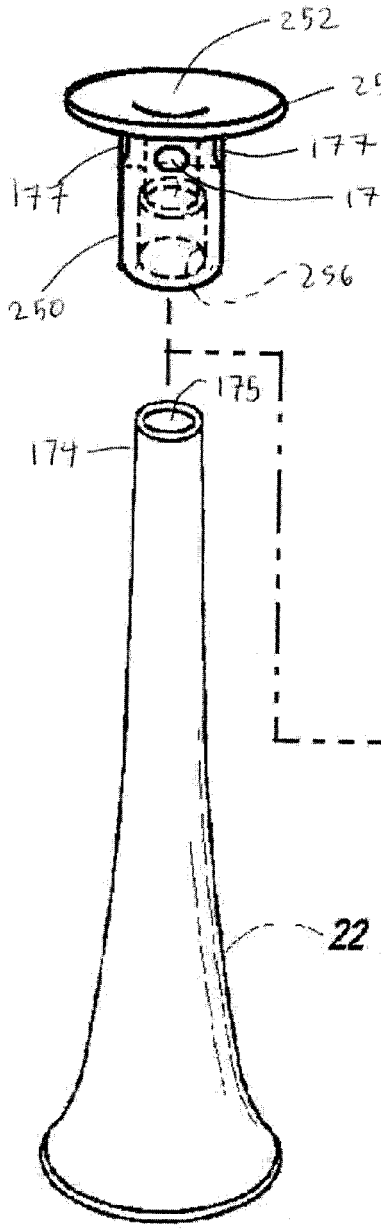
FIG. 19
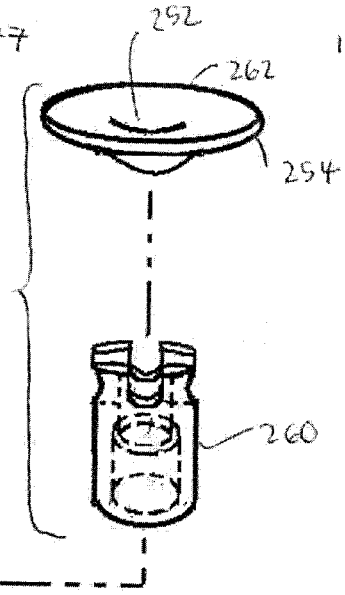
FIG. 20
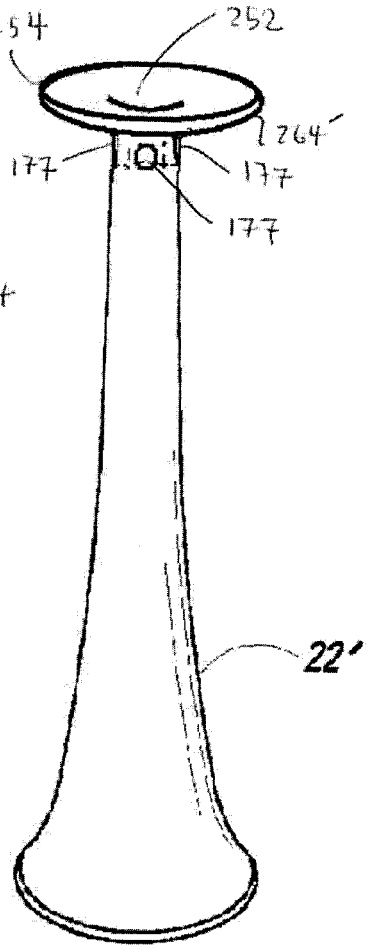
FIG. 21
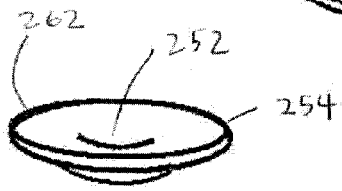
FIG. 22
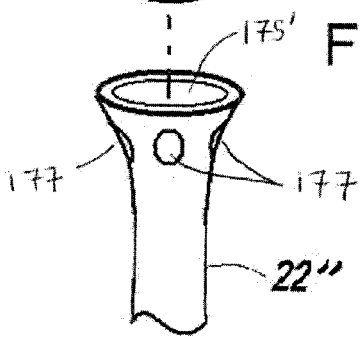

APPARATUS AND METHOD FOR EXTINGUISHING A FLAME UPON DISTURBING THE APPARATUS

CROSS REFERENCE TO RELATED APPLICATIONS

This application claims priority to U.S. provisional application Ser. No. 61/447,725 filed Mar. 1, 2011, the content of which is incorporated herein by reference thereto and relied upon.

COPYRIGHT & LEGAL NOTICE

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever. Further, no references to third party patents or articles made herein are to be construed as an admission that the present invention is not entitled to antedate such material by virtue of prior invention.

BACKGROUND OF THE INVENTION

The invention relates to a device for rotating a fire, flame, a plume of smoke or for circulating heat.

Light, especially candlelight, and/or smoke-producing devices are known. With such known devices, a heat source and a means for generating a flame and/or a plume of smoke are arranged in a chamber having a gas inlet and a gas outlet. The gas inlet opening and the heat source are arranged at a bottom of the chamber and the gas outlet opening is arranged in an upper region of the chamber, so that, an ascending gas flow (draft) is produced in the chamber.

With such known devices, a flame or a plume can be moved, but apart from an irregular motion caused by the gas flow turbulence generated by a flame or smoke plume, there are no regular movements, and especially no functionality which rotates a flame or a plume of smoke.

There exists, however, a device which creates a vortex with a flame, such device imparting the motion of the flame via an electric fan. However, such device cannot create the vortex solely based on the draft created by the flame or heat source.

The goal of the invention is to solve the problem of providing a device for light and/or smoke generation which imparts rotation to a flame or a plume of smoke using the simplest possible means.

In another embodiment of the invention, a candle is provided which may be used with the candle holder of the invention, given that different wax combinations cause differing flame movement in the flame holder of the invention. Candles exist, particularly those in tealight form, which may be used with the flame holder of the invention. However, such candles provide no means, within a single candle, particularly, within a single tealight, of being able to select a color combination, or a wax composition, to suit a particular fancy or desire burning characteristic.

SUMMARY OF THE INVENTION

This problem is solved in the above-described device, by providing at least one gas inlet opening formed as a channel or a nozzle, wherein the gas inlet channel or gas inlet nozzle is designed so that gas flows through them into the chamber in the lower volume thereof, rotating about the heat source and then following a spiral path toward the gas outlet opening. Alternatively or in addition to the inventive solution, at least two, and preferably three or more gas inlet openings can be provided in the above-described device which are each configured to allow an inflowing gas to flow through them into the chamber into the lower chamber volume in a rotating flow around the heat source and to follow the same or analogous courses as gas entering from other such inlets. Both inventive solutions enable the rotating of a flame or a plume of smoke by passive means.

In a particularly advantageous embodiment of the inventive device, the at least two gas inlet openings are each designed to direct inflowing gas through them into the chamber in a gas inflow direction, the direction vector of which has one component parallel to a tangent to an imaginary circle which corresponds with the directional sense of rotation, which extends inside the chamber in a plane level with the heat source and which rotates about this in a circle around the chamber's center, and wherein the at least two gas inlet openings are preferably arranged at evenly spaced locations in the chamber wall along the imaginary circle surrounding the heat source. It is believed that the optimal sense of rotation of the gas in the chamber is dependent on whether the device is to be used in the northern or southern hemisphere of the planet. Due to the jets of gas flowing into the chamber in the same rotational sense, each of which avoiding the heat source, a rotational movement of the gas inside the chamber is generated around the heat source. When the heat source is a flame, this rotational movement of the gas in the chamber moves around the flame to the flame, so that the flame is also rotated therewith. A typical plume of smoke rising above the heat source follows a helical, winding, upward path around a vertical axis to the upper gas outlet.

Preferably, the chamber is formed by a chamber housing, wherein the lower part of the chamber is formed as an enlarged portion and wherein the upper area of the chamber acts as a chimney to the enlarged portion. The enlarged portion accommodates the heat source and, if necessary, the smoke source, while the chimney-section produces, along with the directed gas inlet openings in the base of the chamber, an ascent path of the gases in the chamber induced by the draft created by the heat source.

The gas inlet openings can be formed as gas inflow oriented channel sections or can be formed as nozzles. Thus the air current of an inlet gas through a gas inlet opening is forced along a flow direction following the direct line of communication between the location of the respective gas inlet opening and the enlarged area of the chamber in which the heat source is located. Alternatively or additionally, concerning the gas inlet openings, the means of orientation of gas inflow may be located on the inside of the chamber wall. In a specific embodiment, these channel sections are formed as a straight channel extending from the outside to the inside wall of the chamber through the chamber wall, as a hole or bore through the chamber wall. Instead of a bore, the channels can be formed as any desired form, for example, rectangular cross sections. The alignment of the channel sections is preferably such that the axis of the channel and the tangent of the wall in the area of the channel form an acute angle. This angle should lie in the range between approximately 5° to 45°. In this way, deceleration of the inlet gas by "wall friction" with the chamber inner walls can be minimized, and secondly, a sufficiently large torque can be exerted on the gas in the chamber, so that a sufficiently strong rotational movement of the chamber gases can be attained around the heat source.

Preferably, the chamber wall should have a base or enlarged portion of the chamber housing with a circular cross section in plan view. However, an elliptical, or regular polygonal cross section in plan view may also be suitable where the derogations from a circular form are not enough to disturb the rotation of air flow in the chamber. Also, the chamber wall of the chimney-section of the chamber housing should have a corresponding circular, or, possibly elliptical, or regular polygonal cross section in plan view along a horizontal plane at any height of the chimney-section. This chamber geometry in the lower and upper chamber area, particularly the circular cross section, minimally disturbs the rotational movement of the rising gases in the chamber. Particular preference is therefore an embodiment in which the base or enlarged section of the chamber and the chimney sections are rotationally molded about a common vertical axis of symmetry.

Particularly advantageous is when the chamber has at least three gas inlet openings. The distribution of total inlet gas on three or more gas inlet openings better ensures that at none of these openings is the inlet gas flow rate too high, thus avoiding unwanted turbulence. The laminar inflow of the gases thus generated by the gas inlet openings and the consequent laminar flow of the gas inside the chamber contribute to the stable, defined rotating flow of the gas in the chamber. Turbulent, non-stationary swirling of the gas will be so avoided, leading to a uniform rotational movement of a flame at the bottom of the chamber such that the rotating flame resembles a small banner or flag deflected from the horizontal axis, rotating on its vertical pole. When extinguished, a relatively unsmeared, i.e., well-defined plume of smoke is created which helically rises at least in the bottom portion of the chamber.

Preferably, the gas inlet openings are distributed evenly and arranged at locations in the chamber wall which correspond to different, equally-spaced apart locations along the circumference of the imaginary circle surrounding a heat source. This spacing ensures a uniform, even circularly symmetrical flow of gases around the central vertical axis of the chamber, which promotes, through the already mentioned laminar inflow through the openings, a uniform, virtually steady flow of gas in the chamber.

Preferably, the chimney-section of the chamber housing is tapered inwardly from the bottom to the top, i.e., the horizontal cross section of the chimney of the chamber housing decreases with increasing height in the chamber. It is particularly advantageous when the chamber tapers in the fireplace area from bottom to top in a conical or hyperbolic manner. These features also inhibit turbulence in the ascending gas flow by better ensuring a smooth, uninhibited exit of gases which optimize the updraft. Note that a chimney portion having a slight bottle neck may be used but is not ideal because the escaping hot air will be hindered at the bottle neck, and so, it is more likely that unwanted turbulence will result.

The heat source can be formed by any means for generating a flame, such as in particular through a candle flame, an oil lamp flame, a gas lamp flame or the like. In particular, alcohol as a liquid fuel can be used for the flame. Alternatively, the heat source can be formed by a resistive heating element which is particularly useful when the invention is used as a heater for a home. The inventive apparatus can be both a source of heat as well as include a smoke source, wherein the means for generating a plume of smoke and the smoke source can be a stick of incense, an incense cone, incense pyramid or hut, or the like. Such an embodiment should be used together with a centered flame, in order to generate enough draw to circulate air in the chamber.

There is utility in at least parts of the chamber wall being made of a transparent material, which preferably consists of the chimney-section of the chamber housing made of translucent or transparent material. The base or enlarged portion of the chamber housing may be made of metal, ceramic, polymer, stone, brick, concrete, or the like. Preferably, the chamber housing is formed of multiple components, with the base or enlarged portion of the chamber housing comprising a first portion, particularly of metal or a ceramic, and a second portion, the existing chimney-portion of the chamber housing, consisting of glass, preferably heat resistant boron silicate glass. It is particularly advantageous when the chimney-part is sealingly seated on the base portion, in a removable manner. Thus, in this manner, the intake of "unwanted air" from undefined or unknown points of the apparatus can be avoided. In the multi-part version, the channels can be formed by slits in the upper wall edge of the base portion whose upper surfaces are sealed by a horizontal flange which extends from the edge of the chimney section. Such slots can e.g. are formed by sawing or milling and then closed in its otherwise open upper part to create a channel capable of directing gas inflow. Where the invention is used as a fireplace and chimney, such slots can be formed by bricks or of concrete.

The base or enlarged portion can have a form, in particular, a depression, which receives the heat source. The depression can, for example, serve for receiving a candle in the form of a tea light candle. The candle flame is thus located just above the chamber floor, at the level of the top surface of base portion, in order to ensure that the flame is visible during use. Preferably, the gas inlet openings are arranged in the chamber wall at the same level as the source of heat inside the chamber. This ensures that at approximately the height of the heat source of the rotary portion of the flow, the horizontal components of flow velocity are large, compared to the rising proportion of the flow, i.e. the vertical component of flow velocity. The flame is then induced to turn like a rotating flag around its flagpole, around its wick. Due to the rejuvenation of the upper chamber area, the chimney-gases rise more rapidly during their upward climb toward the gas outlet opening. During which time laminar flow conditions exist in the bottom of the chamber, turbulence can occur at the top of the chamber near the outlet opening. Turbulence is not completely eliminated. In the case of a rising plume of smoke, this means that just before their exit from the apparatus, the plume becomes intermingled, i.e. smeared. Nevertheless, over a considerable height of the chimney, the smoke plume can appear as an upwardly moving, winding lamellar thread.

To further enhance the inventive system, a vaporizable fragrance may be placed in the chamber. The heat provided by the heat source promotes the evaporation of scent. Furthermore, the fragrance is quickly delivered by the chimney to the environment. The aforementioned turbulent swirling in the gas outlet opening contributes to the rapid and uniform distribution of fragrance molecules in the environment.

To provide special lighting effects, e.g. projection of the light generated by the rotating flame to the walls of a room, reflective surfaces can be fitted to sections of the chamber inner wall. Alternatively, longitudinal sections comprising say 90 or 120 degrees of the circumference of the chimney portion, can be fitted with a reflective surface or treated so as to have reflective properties such as are mirrored surfaces on mirrors. In another embodiment, shades with cutout patterns can be placed around the device. When the flame moves, such patterns are projected on the walls of the room. Of course, the chimney portion can be made of different colored glass or a mix of different colors which will provide a further unique visual effect when light from the flame is projected on the wall.

Usefully, the heat source and the source of smoke are co-located or very close to each other, or the smoke enters through a gas inlet (which, because of temperature differences and smoke condensation, must be carefully arranged). This helps pass the smoke immediately into a defined laminar flow so that a plume of smoke can be visible as it travels to the upper gas outlet.

Preferably, the heat source and/or the smoke source are located at the center of the lower area of the chamber. As already mentioned, where the rotating portion of the gas flow is relatively large compared with the rising proportion, there may even be the possibility of arranging multiple heat sources and/or smoke sources, all of which should, however, preferably be in the middle near the base of the chamber.

In a specific embodiment of the inventive system, the chamber can be height adjustable, so that the height difference between the position of at least one gas inlet opening and the position of the gas outlet opening can be varied. This allows the updraft of the gas flow in the chamber, as well as the volume of gas in the chamber, to be adjustable.

In another specific embodiment, the entire device is constructed in one piece or all the parts forming the device are rigidly connected. Such one-piece device is preferably made of glass or a heat resistant, transparent polymer such as "PEEK". To produce such a device, one preferably uses a casting or injection molding process. This allows for the production, together with the gas inlet openings, to be formed in a single step. In such an embodiment, the candle or other heat source enters through an opening in the bottom of the single piece unit, to an appropriate position where the flame is approximately at the level of the gas inlet openings. In this case, it is advisable to place the candle on a ceramic or metal, or otherwise fire resistant saucer in order to protect the surface on which the candle is placed from heat or wax staining.

One can also provide further adjustability of the device by allowing the direction and/or the cross section of the inlet port forming the channels or nozzle to be adjustable. When using jets or channels, which taper inwardly toward the outlet end on the chamber, this consciously takes an awareness of the swirling turbulent gas flowing in the chamber into account. This is nevertheless tolerable, since the incoming gas, in comparison to the turbulent motion components, define a directional drift component which is set by the orientation of the nozzle axis.

In another embodiment, a candle assembly is provided having at least one wick, the candle assembly formed of at least two wax parts which interface together to allow selective juxtaposition of wax parts having desired color combinations, scents, and wax compositions. The parts, when fit together conform to in inner form of a receptacle, and are held together with the at least one wick in such receptacle. Optionally, at least one part has a recess into which the at least one wick may be held in place or positioned to facilitate accurate assembly.

Further, other modifications of the invention, including adaption to heat an aromatic oil or the use of composite tealights or lamp oil cartridges supplement the versatility of the invention.

BRIEF DESCRIPTION OF THE DRAWINGS

Further advantages, characteristics and applications of the invention emerge from the following, non-limiting description of an embodiment of the invention, wherein:

FIG. 10 is a perspective view of an alternate embodiment of the candle holder of the invention.

FIG. 11 is an exploded view of the alternate embodiment of FIG. 10.

FIG. 13A is a perspective view of a first embodiment of a flow restrictor for use with the invention.

FIG. 13B is a cross sectional view of the flow restrictor of FIG. 12A taken along line A-A.

FIG. 14 is an exploded view of an alternate flow restrictor for use with the invention.

FIG. 19 is an exploded view of a chimney adapter of the invention.

FIG. 20 is an exploded view of an alternate chimney adapter of the invention.

FIG. 21 is a perspective view of an alternate chimney of the invention.

FIG. 22 is a partial perspective view of a second alternate chimney of the invention.

Those skilled in the art will appreciate that elements in the figures are illustrated for simplicity and clarity and have not necessarily been drawn to scale. For example, the dimensions of some of the elements in the figures may be exaggerated relative to other elements to help improve understanding of various embodiments of the present invention. Furthermore, the terms 'first', 'second', and the like herein, if any, are used inter alia for distinguishing between similar elements and not necessarily for describing a sequential or chronological order. Moreover, the terms 'front', 'back', 'top', 'bottom', 'over', 'under', and the like in the Description and/or in the claims, if any, are generally employed for descriptive purposes and not necessarily for comprehensively describing exclusive relative position. Skilled artisans will therefore understand that any of the preceding terms so used may be interchanged under appropriate circumstances such that various embodiments of the invention described herein, for example, are capable of operation in other configurations and/or orientations than those explicitly illustrated or otherwise described.

DETAILED DESCRIPTION OF THE PREFERRED EMBODIMENT(S)

The following descriptions are of exemplary embodiments of the invention and the inventor's conception of the best mode and are not intended to limit the scope, applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

Figure 1:
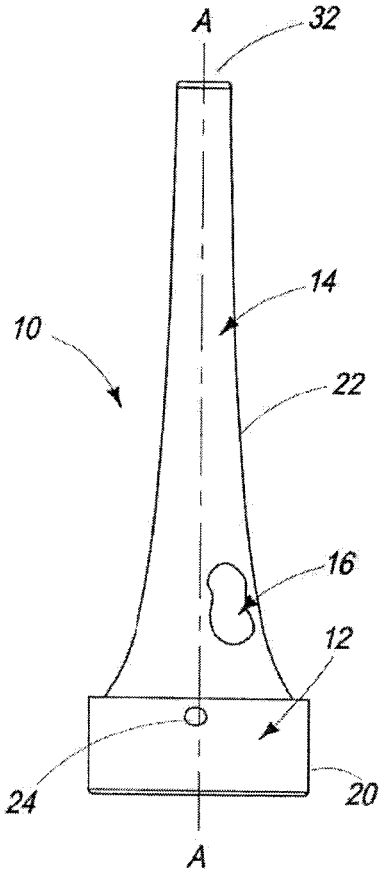
FIG. 1 shows a side view of the inventive system.

Referring to FIG. 1, a side view of the device 10 of the invention is shown. One can see a bottom portion 12 and an upper section 14 which define the chamber 16. The lower section 12 of the chamber 16 is formed by a base portion 20, while the upper section 14 of the chamber 16 is formed as a chimney-section 22. The lower section 20 and the upper section 22 form the chamber 16. In the lower base section 20, there are three gas inlet openings 24, 26, 30 (see FIG. 3) define channels 40 that pass from the exterior to the interior of the base portion 20, into a recess 20' formed therein, one of which is shown in FIG. 1—here, only the gas inlet opening 24 is visible. The chamber 16 is preferably rotationally symmetric about the axis A-A. The gas outlet opening 32 is formed at the upper end of the upper chimney section 22.

Figure 2:
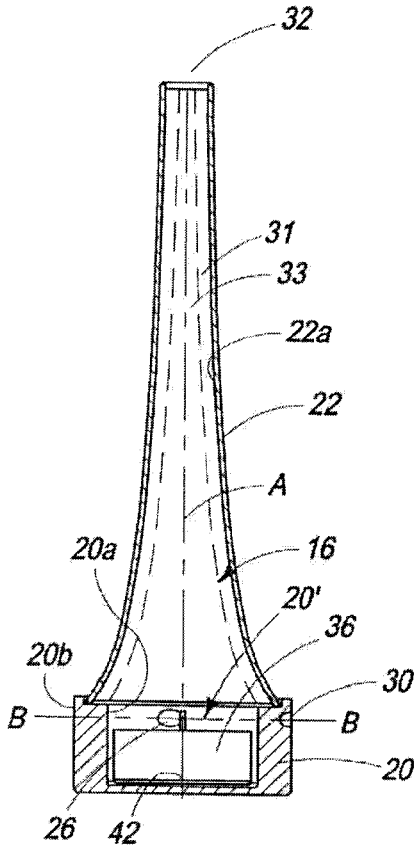
FIG. 2 shows a sectional view of the apparatus of FIG. 1 along a vertical plane through the axis A-A of FIG. 1.

Referring to FIG. 2, a sectional view of the apparatus of FIG. 1 is shown taken along a vertical cutting plane passing through the axis A-A of FIG. 1. All the elements of FIG. 2 which correspond with the elements of FIG. 1 bear the same reference numerals as in FIG. 1. The same is true with all figures. In this section, the view formed by the chamber portions 20 and 22 is shown. The base section 20 surrounds the lower portion 12 of the chamber 16. In this lower area inside the recess 20' of the base section 20, a candle 36 is disposed. The candle 36 is in the form of a tea light candle, having standard dimensions known in the art. The depth of the lower region 12 of the chamber 16 corresponds to the height of the wax body **36*b* of a new tea light. In this embodiment, the wick 36*a* of a new tea light candle is located approximately at the same height as the three-gas inlet openings 24, 26, 30 in the base portion 20. These three gas inlet openings 24, 26, 30 define a plane B which extends perpendicular to the axis A-A. In FIG. 2, only the gas inlet openings 26 to 30 are at least partially visible. The chamber inner wall in the lower section 12 of the chamber 16 bears the reference numeral 20*a*. The chamber inner wall in the upper part 14 of chamber 16 bears the reference numeral 22*a***.

Dashed lines 31 bound, in exemplary fashion, an area 33 where the chimney 22 may preferably be mirrored. The effect of such mirroring is that one can better see multiple reflections 33 of the rotating flame 28 on the mirrored surface 33—(visible even without a mirrored surface 33 in FIG. 7).

Figure 3:
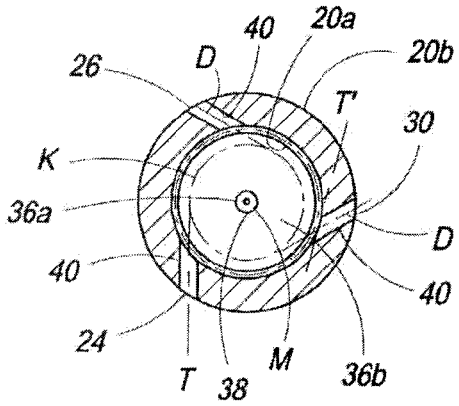
FIG. 3 is a sectional view of the apparatus of FIG. 1 taken along the horizontal axis BB of FIG. 2, a horizontal cutting plane.

FIG. 3 shows a sectional view of the apparatus of FIG. 1 along the cutting plane B-B of FIG. 2. One can see the three gas inlet openings 24, 26, 30, each of which is formed as a channel 40. The wick **36*a* of the tealight is located in the center M of an imaginary circle K, which, for example, can be randomly concentric with the outer edge of the round tea light 36. Between the imaginary circle K and the inner wall 20*a* of the chamber wall 20 is a radial distance which corresponds roughly to a radius of an air inlet of a channel 40. Further, the radius of the chamber inner wall 20*a* is larger than the radius of the wax body 36*b* of tealight 36. The longitudinal axis D of the channel section 40 of each gas inlet opening 24, 26, 30 continues along a tangent T to the imaginary circle K and, at the same time, the longitudinal axis of the channels D of each gas inlet opening 24, 26, 30 forms a sharp angle between 5° and 45° with a tangent plane of T' of the chamber inner wall 20*a*, when the angle measured is the angle which opens to the outside (away from the center) of the device 10**.

Optionally, in order to better center the tea light candle 36, a magnet 38 is disposed in the center, on the floor of surface 42. A typical tealight candle 36 includes a ferromagnetic panel (usually of steel) to which the wick **36*a*** is attached and is located at the bottom of the tea light, thereby providing a centered ferromagnetic object that the magnet is attracted to, thereby helping center the tealight.

Figure 4:
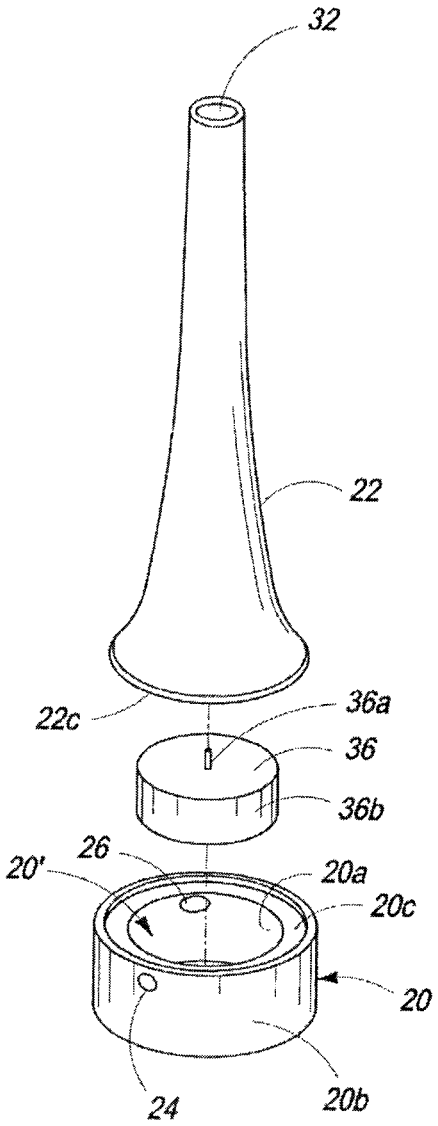
FIG. 4 is a perspective exploded view of the apparatus of FIG. 1 showing the respective components represented in an exploded condition along the axis A-A of FIG. 1.

FIG. 4 is a perspective exploded view of the apparatus of FIG. 1, the components of which are represented in perspective, exploded view, along the axis A-A of FIG. 1. The base section 20 and section of the chimney 22 are designed as separable parts. The lower edge **22*c* of the chimney section 22 fits into a complementary recess or shoulder 20*c* of the base section 20. If one places the chimney section 22 on the base section 20 in the shoulder 20*a*, one obtains, between the bottom edge 22*c* and the shoulder 20*c*, a sufficiently tight connection to prevent the intrusion of too much unwanted air into the chamber 16. On the base section 20, the gas inlet openings 24, 26 extend through the wall of the base section 20 from the outside 20*b* to the inside 20*a*. The tealight 36 can be inserted into the socket or recess 20' of section 20, which is slightly larger than the wax body 36*b* of the tealight 36, thus facilitating insertion and removal of the tealight 36**.

In order to place the device shown in FIGS. 1-4 in operation, one need only place a tealight 36 in the base recess 20' and light the wick **36*a* of the tealight 36. Then one places the chimney section 22 on the base-section 20, so that the lower edge 22*c* of the chimney section 22 and the shoulder 20*c* of the base abut against one another thereby sealing base portion 20 against chimney 22. By means of the flame 28 (e.g., shown in FIG. 7) of the tealight 3, the air in the chamber 16 is heated and expands. This creates a draft in the chamber 16, whereby air from the vicinity of the gas inlet openings 24, 26, 30 is sucked into and along the channels 40 into the chamber 16. The entering air enters through the channels 40, in particular, along the channel axis T into the chamber 16 and then around the center M of the chamber 14 along the wall 20*a*. The incoming air creates, on the one hand, a rotational movement of the air in the lower section 12 of the chamber 16 around the wick 36*a* or flame 28. On the other hand, it is not directed directly toward the wick 36*a*, but rather the flame 28** heats and activates the air which ultimately flows out from the chamber 16 via the gas outlet opening 32. Due to the interaction of the incoming air which enters obliquely through the gas inlet openings 24, 26, 30 and it's being heated, the flame 28 moves at the wick 36*a*.

With closed holes 24, 26, 30, and no chimney section 22, the flame extends, assuming no wind, along the vertical axis A-A (see FIG. 1). With open holes 24, 26, 30, and the chimney section 22 attached, the flame 28 will nevertheless be deflected from the vertical axis A-A and be rotated around this axis.

The rotation of the flame 28 is relatively slow. Depending on the size of the gas inlet openings 24, 26, 30, the height of the structure and size of the gas outlet opening 32, the time required for a full rotation of the flame may be about 0.2 s to about 1 s. With a length of each channel 40 being about 1 cm, a diameter of about 4 mm for a circular channel cross section (for a bored hole), a height of the chimney section 22 being about 15 cm, a diameter of the circular opening 32 being about 1.5 cm, and an ambient temperature (i.e., air inlet temperature) of about 25° C., the flame rotation of a tealight of the inventive system is about 1 s per revolution.

The rotation of the flame 28 takes place smoothly, but probably not at a completely constant flame rotation speed. Rather, it is speculated that, particularly, if the wick 36*a* is not in the center, the rotational motion can slow down once per every flame revolution, and even stop. This irregularity in or ceasing of the rotation is due to a flame source, the wick 36*a*, being eccentric to the axis A-A, or, in part, due to a curvature of a centrally disposed wick itself. This moving flame 28 can be used with (not shown) mirror surfaces and/or an iris pattern on the chimney section 22-10 to create a "moving" illumination of a room, moving with a period identical with the speed of rotation of the flame 28.

The hyperbolic (shown) or conical (not shown) upwardly tapered chimney section 22 is composed of a material transparent to visible light, preferably flame and heat resistant glass. The glass may be of different colors or even a mix of colors, to provide a different aesthetic effect.

As already mentioned, by the geometry of the device (basically the size and number of gas inlet openings 24, 26, 30, the height or the chamber volume of the device, the size of the gas outlet opening 32 and the shape of the chimney section 22 and the size of the flame 28, the type and manner, especially the speed, of the flame's turning, can be influenced.

Astonishing is the fact that, in the inventive system, the flame 28 is both driving element and the driven element. The flame 28 produces the necessary energy for the movement of air and its own movement (movement of the flame-forming luminous particles in the rising air). By means of the inventive system, the flame is driven into continuous rotation.

There are several means for generating both a flame 28 and/or a plume of smoke in the chamber 16, or it can have multiple means for ordering a flame and/or a plume of smoke in the chamber along an eccentrically arranged common vertical axis of symmetry AA. Because of the circulating gas flow in the chamber 16, this results in many interesting smoke or flame patterns.

Figure 5A:
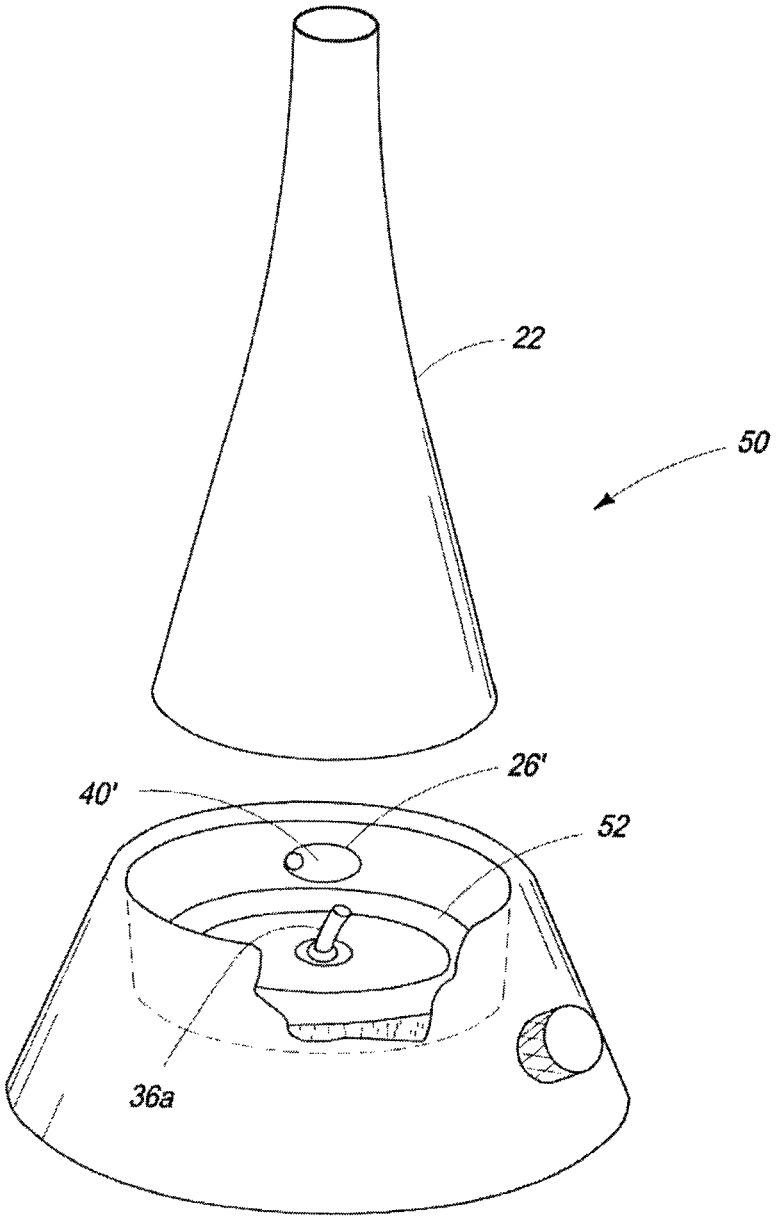
FIG. 5A is a perspective, partial breakaway view of an alternate embodiment of the invention using a liquid or gas fuel and having a depression for containing fragrant oil.
Figure 5B:
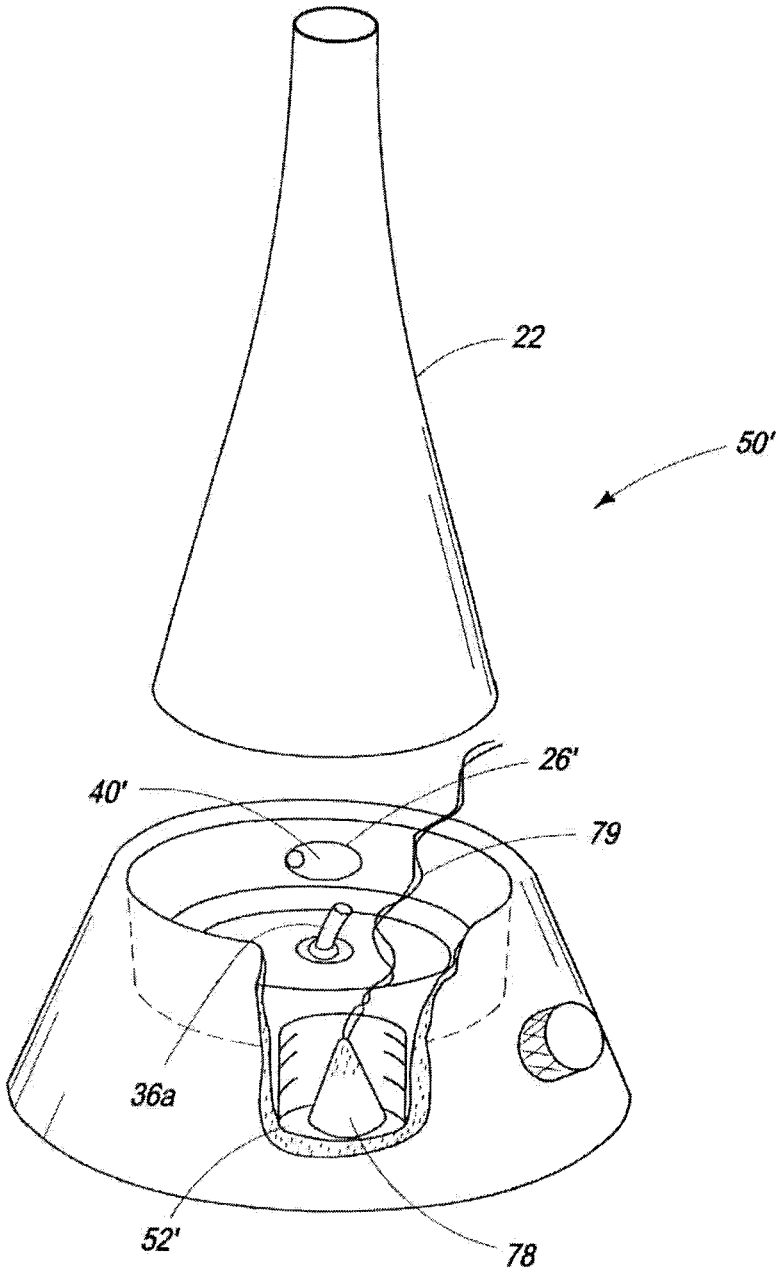
FIG. 5B is a perspective, partial breakaway view of an alternate embodiment of the invention having an internal compartment for burning incense.

FIG. 5A is a perspective view of an alternate embodiment 50 of the invention using a liquid or gas fuel and having a depression 52, in this case, an annular depression centered on the wick 36*a*, containing a fragrant oil. Instead of the candle flame 28 (i.e., a flame whose lower and upper portions do not move downwardly as the fuel is consumed, as in the case with a typical wax candle), a flame fueled by a liquid or gas has the advantage of a vertically stationary flame, thereby providing for consistent circular movement of the flame over the entire time that the flame is lit. Note as well that a buoyant candle (not shown) may be used which floats in a liquid such as water, which is provided in the cavity 20' in which the candle is placed. Alternatively, magnets (not shown) having sides which face each other having the same polarization can be used to create a magnetic levitation of the candle, helping to keep the flame at the same level during the burning of the candle. A small compression spring (not shown) can help maintain the level of the flame of the candle, because as the candle burns, although the flame burns downwardly, the candle becomes lighter and so the spring helps move the candle upward as the flame burns downward, an effect which helps cancel out the tendency for the flame 28 to descend as the wax burns. A selection of the correct spring constant for the weight of the candle therefore, is all that is needed to help maintain the flame level. In FIG. 5B, an embodiment 50' is shown having an internal compartment 52' for receiving incense 78, whose smoke 79 rises and mixes with the swirling gases in the chamber 16, when the device is placed in operation.

Figure 6:
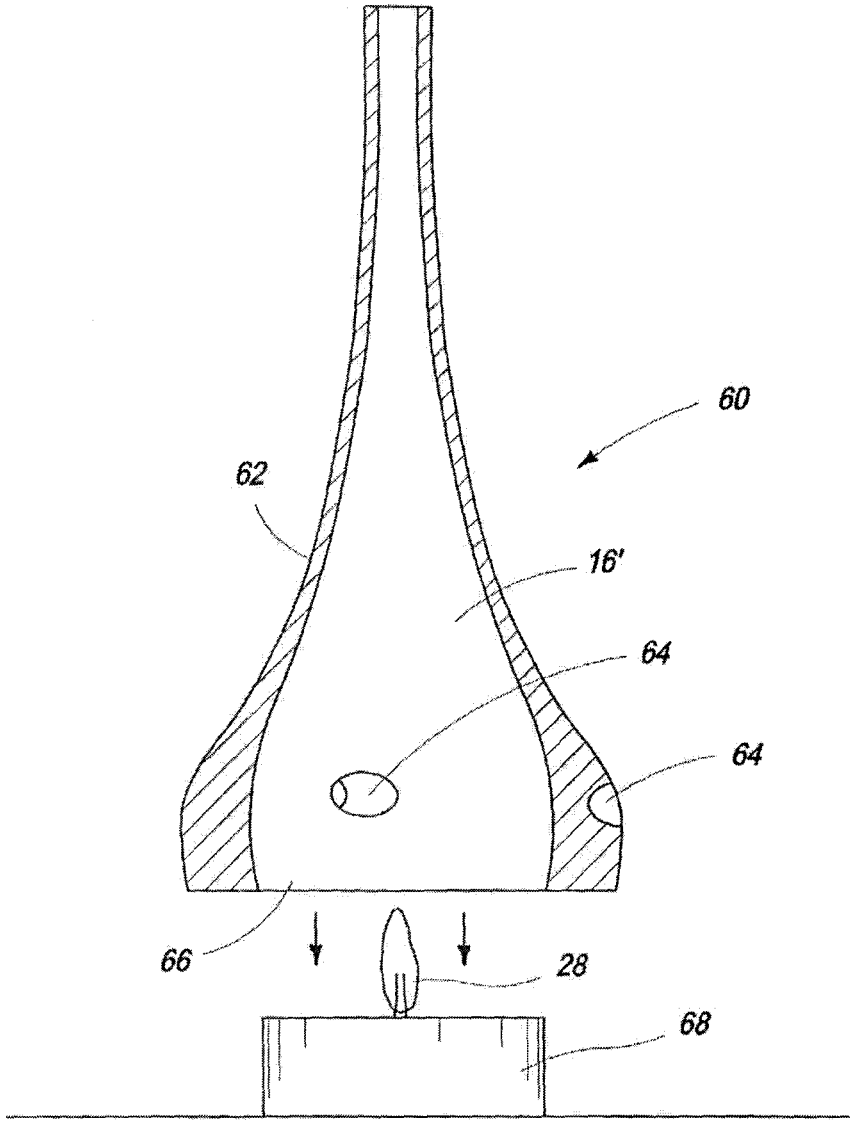
FIG. 6 is a cross sectional view of a second alternate embodiment of the invention, made in a single piece.

FIG. 6 is a cross sectional view of a second alternate embodiment 60 of the invention, made in a single piece, preferably by glass injection molding. An advantage of this embodiment is its simplicity in that it is composed essentially of a single chimney portion 62 in which holes 64 (corresponding to holes 24, 26 and 30) are formed. The lower portion 66 is open and so the device can be placed over a burning candle 68. In addition, using this embodiment, one can adjust the position of the candle very easily, to ensure that the flame remains at the center of the chamber 16', simply by displacing the device, until the desired flame motion is obtained.

Figure 7:
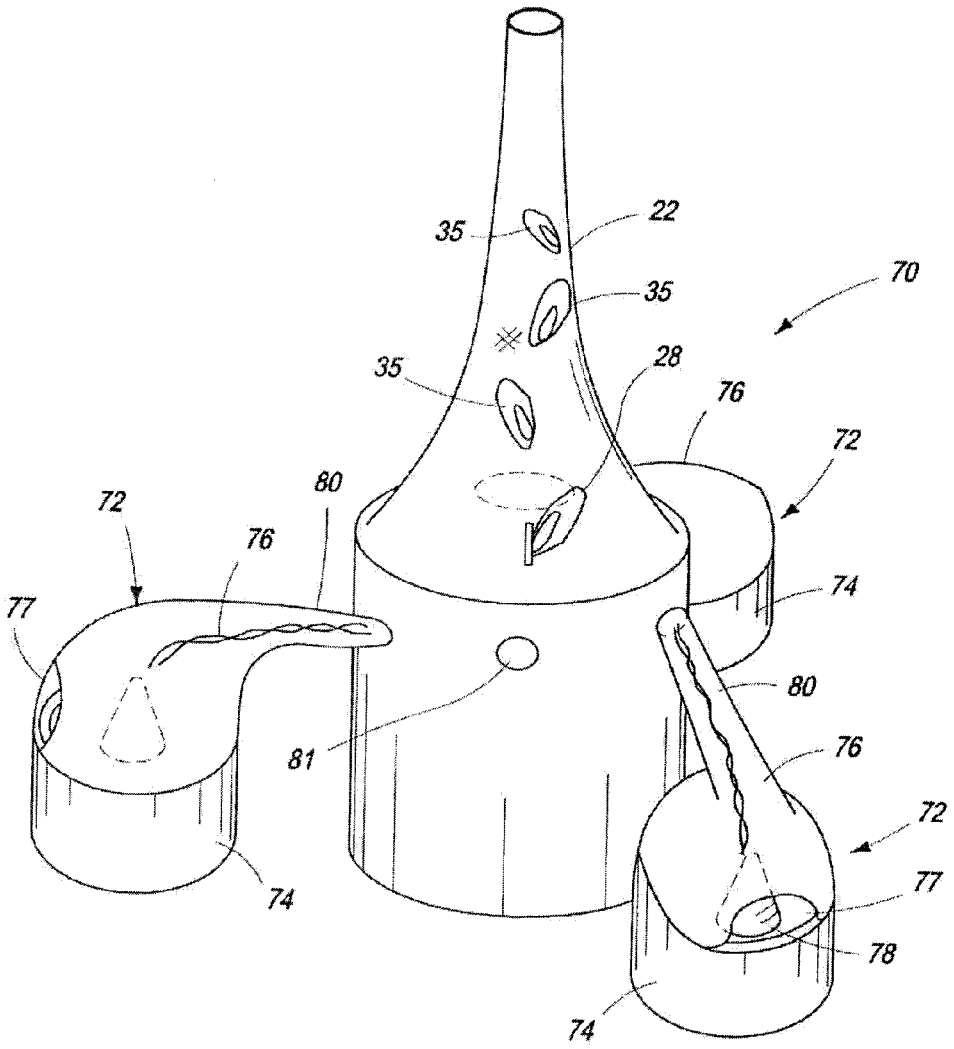
FIG. 7 is a perspective view of a third alternate embodiment of the invention, used to distribute smoke and fragrance from incense.

FIG. 7 is a perspective of view of a third alternate embodiment 70 of the invention, used to distribute smoke and/or fragrance from a plurality of satallitic incense burners 72. These incense burners 72 include a base portion 74 and a transparent cover portion 76 allowing an air inlet opening 77. The base portion 74 receives and contains the burning incense 78. The cover portion 76 directs the smoke and/or aroma of the incense through tube portions 80 which enter into the gas inlet openings 24, 26 and 30, thereby feeding the smoke or aroma into the chamber 22 where it is mixed by the revolving gases and then disbursed in the air through the gas outlet opening 32. Note that the height of the base portion 20 is increased in this embodiment to allow the tube portions 80 to enter at the level of the flame 28 (i.e., to allow for the height of the incense burners 72). Further, where additional oxygen is needed in such an arrangement, additional gas inlet opening/channels 81 can be provided.

Figure 8A:
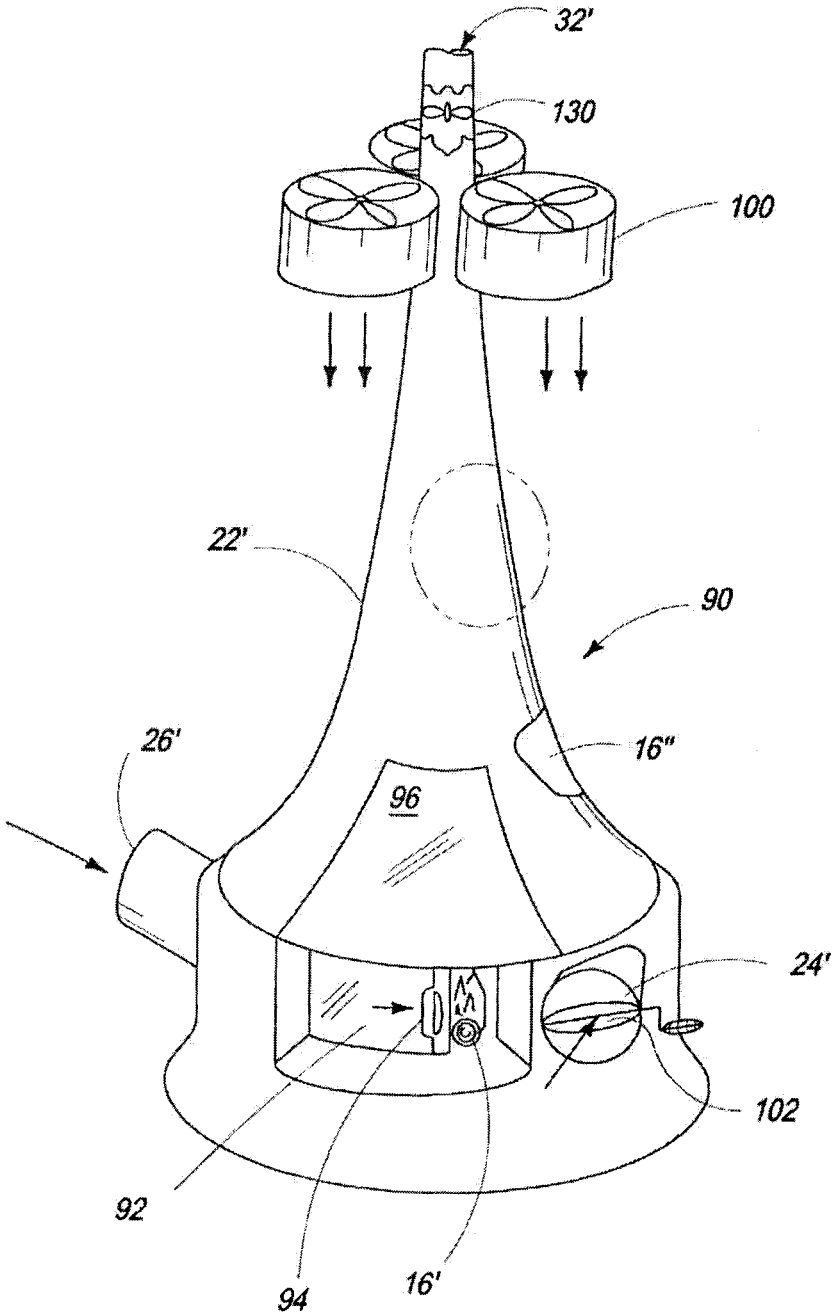
FIG. 8A is a perspective view of a fourth alternate embodiment of the invention, used as a fireplace for a home.
Figure 8B:
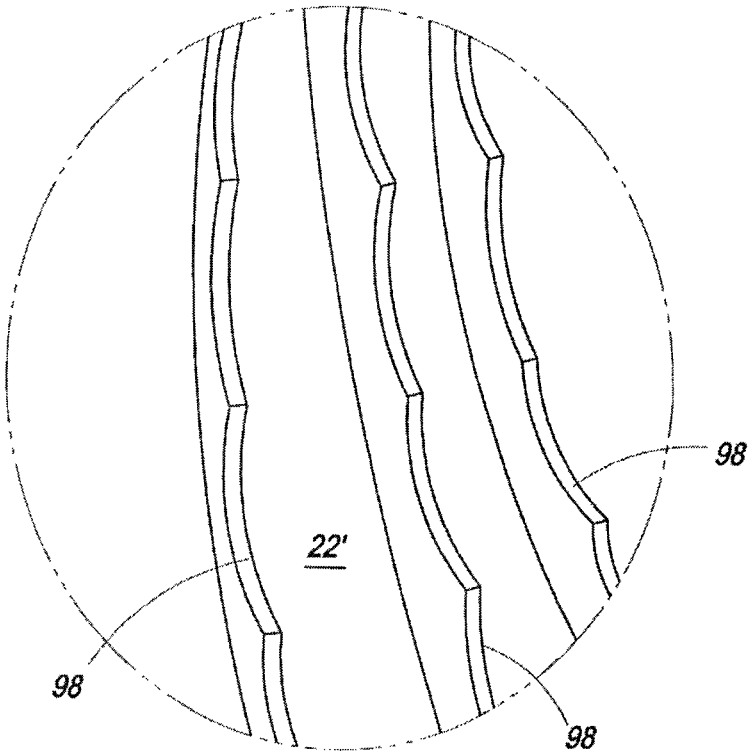
FIG. 8B is a close up view of a portion of the embodiment shown in FIG. 8A.

FIG. 8A is a perspective view of a fourth alternate embodiment 90 of the invention, used as a fireplace of a home. In this embodiment, the most substantial differences with the embodiment for use as a fireplace 90 and the candle holder 10 is that a transparent, sealable door 92, preferably having a handle 94, allows for convenient opening for inserting wood for burning or for providing access for cleaning, and closing which seals the chamber 16' and that the upper gas outlet 32' is connected to a stove pipe or other chimney for evacuation of hot gases, and that a substantial portion of the chimney 22 is formed of a conductive, heat-radiating material such a copper, bronze, steel, iron or aluminum. For aesthetic reasons, a transparent portion 96 of the chimney is provided, allowing for users to view the moving flames inside the fireplace. Further differences include the fact that it is advantageous to include vertical ribs 98 (shown in close up in FIG. 8B) and, perhaps fans 100 which blow ambient air over the exterior portions of the chimney 22' toward the floor, thereby heating the air and recirculation such warmed air in the room while better protecting the user from the danger of touch of the heated chimney 22'. Further, dampers 102 may be provided in each gas inlet 24', 26' and 30', for adjusting the amount of air flow into the chamber 16'. To optimize heating, a computer controlled system controls the position of the dampers 102, the speed of the fans 130, and even the angle of entry of the gas inlet ducts 24', 26' and 30' (for example, using an arrangement shown in FIG. 9). Optionally, fans can be included in the ducts 24', 26' and 30' or in the stove pipe section 32' to be able to further control the convection of heat from the warm gases to the chimney 22' and then into the room. It can also be envisioned that the chimney 22' itself could include tubes carrying a fluid to which the heat is transferred and then pumped and distributed throughout the house, be it to water (i.e., thereby using the system as a water heater) or air (i.e., using the system to heat rooms in the house through ducts which transport the hot air directly to each room to be heated). Still further, a mechanism (not shown) can be provided which uses four bar linkages to raise fingers (preferably at least three) through slits in the floor of the fireplace, to lift and move the embers and burning wood to the center of the fireplace via a remote lever (not shown), in order to optimize the heating effect of the system of the invention.

Figure 9:
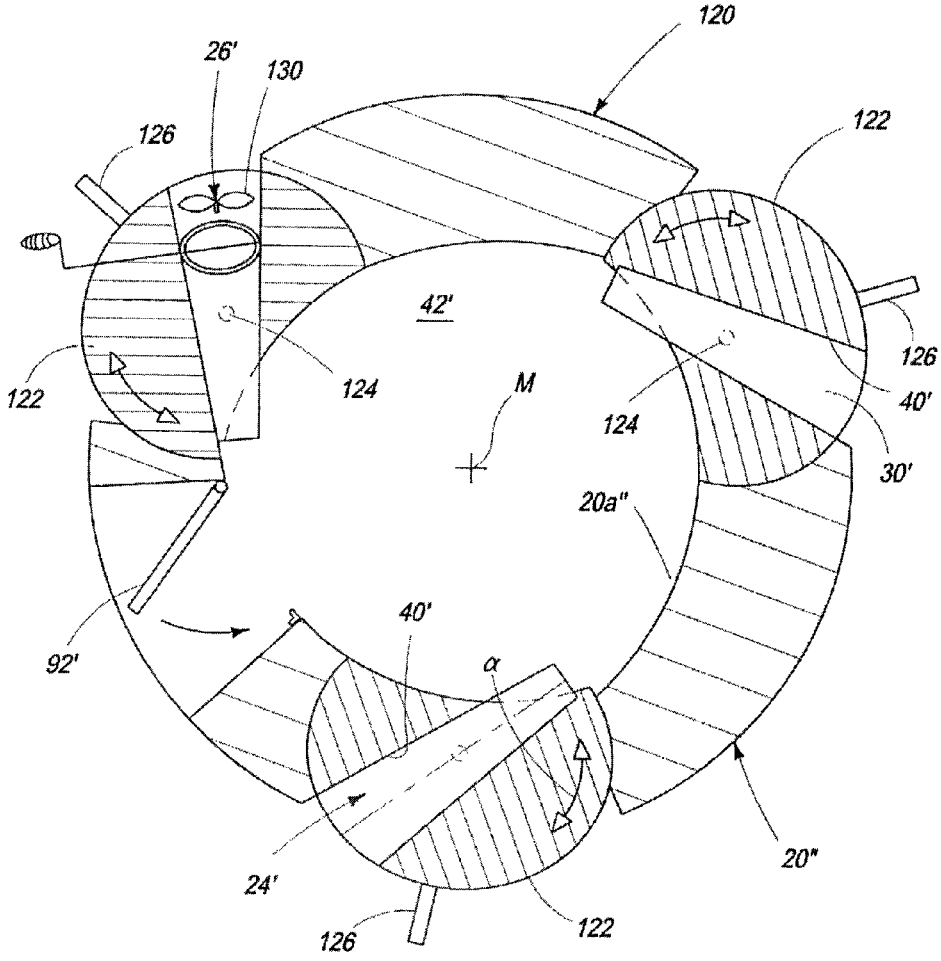
FIG. 9 is a top, sectional view of a fifth alternate embodiment in which the invention includes gas inlets whose direction is adjustable.

FIG. 9 is a top, sectional view of a fifth alternate embodiment 120 in which the invention includes gas inlets 24', 26', and 30' whose direction is adjustable via a housing 122 in which they are formed that pivots on an axis 124. In this embodiment, the angle $\alpha$ can be varied by, for example, moving the housing 122 via the handle 126. Alternatively, as mentioned above, the angle and position, as well as speed of fans 130 can be computer controlled, in order to optimize the heat convection in the system. Note the seals sealing between the housing 122 and the base portion 20" or around the door 92' which seal against unwanted air drafts are not shown, the design of which believed to be well within the capabilities of someone of ordinary skill in the art.

Referring now to FIGS. 10 and 11, an alternate embodiment of the candle holder 130 of the invention is shown as a lower subassembly 132 and the glass chimney 22. The subassembly 132 is made up of an insulated base 134 (preferably made of wood or ceramic), a candle cup 136, a manifold or air flow guide 140, retainer clips 142 and fasteners 144 which, passing through a hole 146 in a flange 150 of the cup 136, sandwich lower loops 152 of the clips 142 between the air flow guide 140 and the flange 150 of the cup. The subassembly 132 partially fits in the opening 154 of the base 134 so that the air flow guide 140 rests on the top surface 156 of the base 134.

Figure 12A:
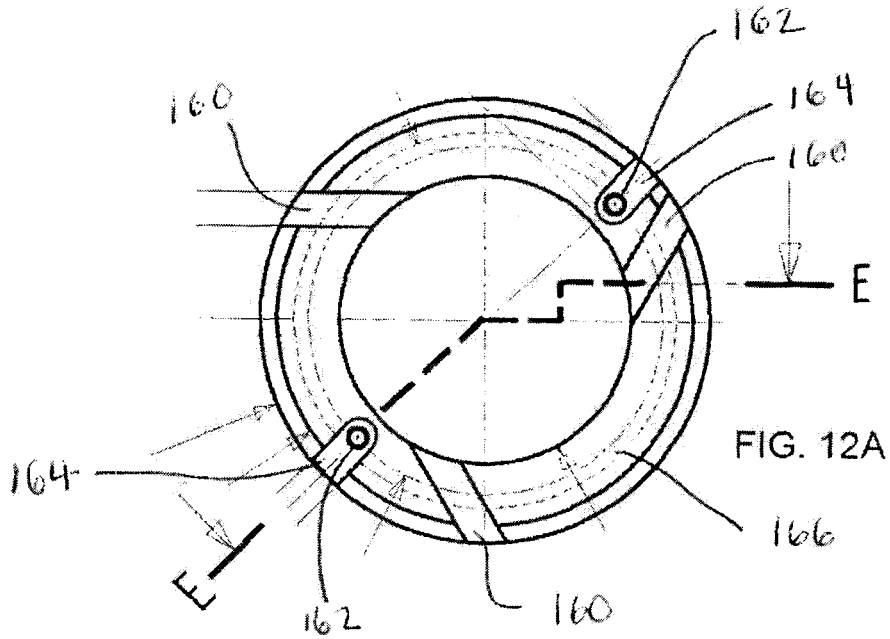
FIG. 12A is a bottom view of an air flow guide of the embodiment of FIG. 10.
Figure 12B:
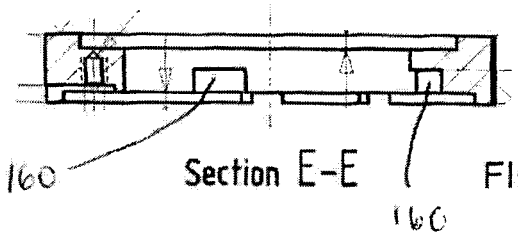
FIG. 12B is a cross sectional view of the air flow guide of the embodiment of FIG. 10, taken along line E-E.

Referring now to FIGS. 12A and 12B, the air flow guide 140 is shown in more detail. Although as few as one is necessary, preferably three air flow channels 160, are formed in the lower portion of the air flow guide 140. Threaded holes 162 receive the fasteners 144. A recess 164 provides room for the lower loops 152 of the clips 142. The flange 150 of the cup 136 abuts the surface 166 of the air flow guide 140.

Referring now to FIGS. 13A and 13B, a flow restrictor 170 for use with the invention has a first cylindrical surface 172 which interfaces with the upper portion 174 of the chimney 22, and a second, smaller cylindrical surface 176 which restricts the flow of exit gases when the restrictor 170 is placed over the end 174 of the chimney 22. Use of the restrictor 170 slows the rotation of the flame 28 of the tealight 36.

Referring now to FIG. 14, an alternate flow restrictor 180 includes an upper, rotatable portion 182 and a lower portion 184 that is fixed against rotation to the end 174 of the chimney 22. An end 186 of a set screw 190 enters an annular recess 192 in the lower portion 184, to permit or prevent disassembly of the flow restrictor 180. Note as well that a spherical valve body (not shown) of a diameter similar to the length of the restrictor 170, could be provided with an internal aperture of a comparable diameter to that of the surface 176, this valve body being held in place by its own weight, and resting on the opening 175 of the chimney 22. Preferably, this spherical valve body would rest on an enlarged, flared opening of the chimney 22 such as that shown in FIG. 22 (except without the air exhaust holes 177). In an advantage, this spherical valve could then be rotated and repositioned on the chimney 22" in order to vary the size of the exit opening, including completely shutting the opening thereby extinguishing the flame. Consequently, it would be advantageous that this spherical valve body be made of an insulating material permitting hand manipulation even when the candle has been burning a long period of time.

Figure 15:
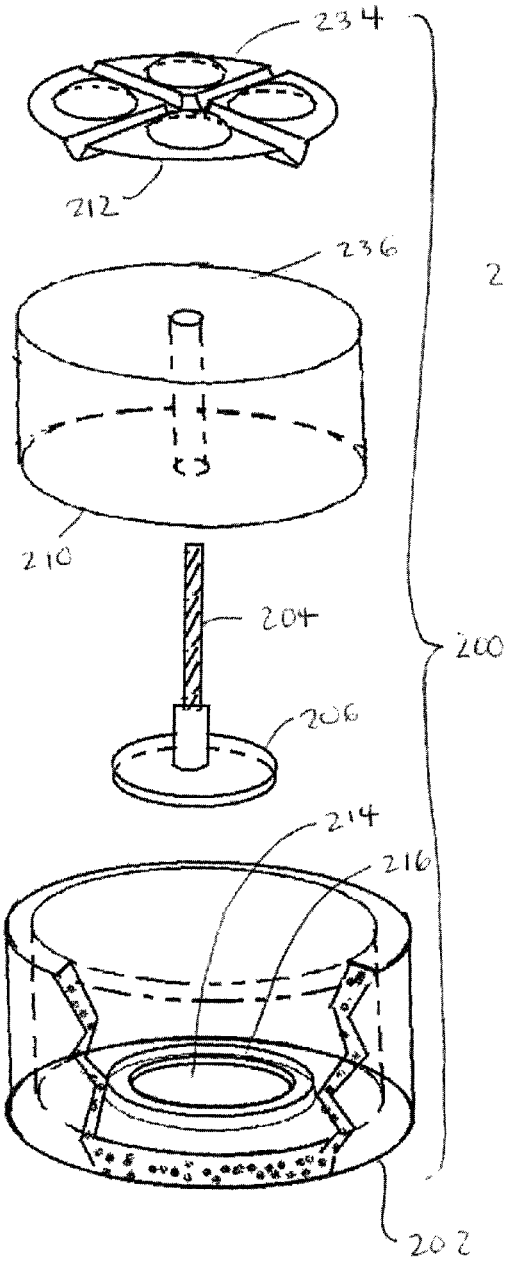
FIG. 15 is an exploded view of a tealight candle of the invention.

Referring now to FIG. 15, a tealight candle 200 especially designed for use in the invention, includes a lower cup 202, a wick assembly 204 including a lower grommet 206, wax 210, and a wick centering device 212. The cup 202 includes a molded recess 214 surrounded by a raised circular wall 216. The wall 216 receives the grommet 206 and prevents the grommet from sliding off center, which can occur when the wax liquefies completely and the subassembly 132 or entire candle holder 10 is moved. In this embodiment, the lower part 235 may be used without the upper part 237 when the domes 244 are present as shown, but is preferably soldered together to form an airtight float (and so the domes 244 may be dispensed with), much like a carburetor float (which is generally made of thin stamped brace components soldered or epoxied together). Soldering or sealingly gluing may be avoided where a cork insert of a matching form (in the form of a washer) is inserted therebetween, thus providing the buoyancy needed to ensure that the centering device 212 floats on the surface of the melted wax. Further, the outer diameter of the centering device 212 is preferably sized a little less than the inside diameter of the cup 220 in order to freely rotate until the wax is burned away. A closer fit seals off the melted wax and prevents contamination of the melted wax as well as other potentially undesirable effects.

Figure 16:
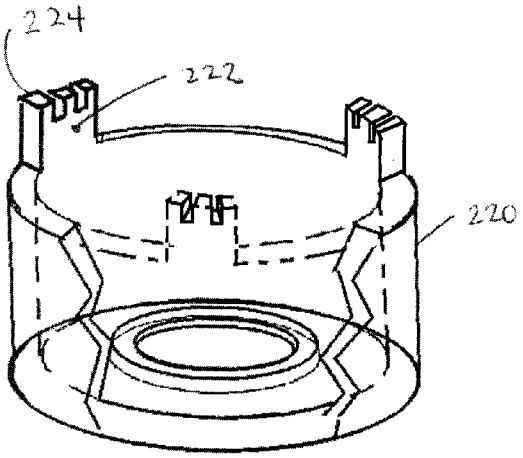
FIG. 16 is a perspective, break-away view of an alternate casing for the tealight candle of the invention.

Referring now to FIG. 16, an alternate tealight candle holding cup 220 designed for use with the invention, includes one or more tabs 222 which can selectively block the air flow through an adjacent channel 160, simply by placing the tealight with such a cup so that the tab is positioned so as to block or partially block such channel 160. A decorative castellated upper portion 224 may also be provided. It should be noted that a whistle structure (not shown) may be formed on the castellated structure in order to create a sound when air inflow passes by the castellated structure.

Figure 17:
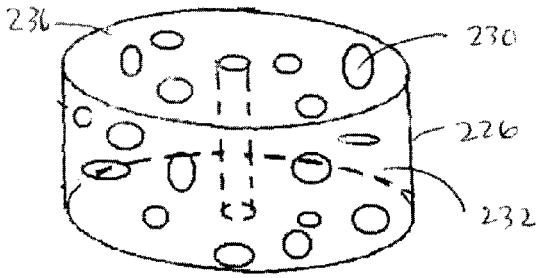
FIG. 17 is a perspective view of an alternate wax composition for the tealight candle of the invention.

Referring now to FIG. 17, an alternate wax composition 226 for an alternate tealight candle of the invention includes different colored wax portions 230 interspersed throughout the ordinary wax body 232, these colored wax portions having a higher melting point than the ordinary wax used, in order to melt later and to cause a swirling visual effect within the ordinary wax. Glitter or other floating articles 234 can be placed on top of or in the wax. These structures 234 can take any form including hollow balls, foil or metal. When the candle holder 10 of the invention functions, a circular wax flow is generated in the upper layer 236 of the candle, this flow being induced by friction with the swirling wind within the candle holder 10. Note that fins 240, such as those shown in the centering device 242 of FIG. 18 could be used. For details of the basic form of the functional elements of the centering devices shown in FIGS. 15 and 18, refer to U.S. Design patent application D468,856, the content of which is incorporated herein by reference thereto.

Figure 18:
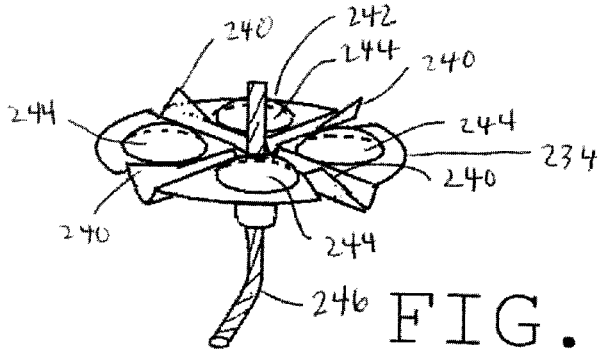
FIG. 18 is a perspective view of an alternate embodiment of the wick centering device of the tealight candle of the invention.

Referring now to FIG. 18, the alternate wick centering device 242 of the invention floats on top of the wax 226 once melted, by virtue of the air compartments 244 which trap air and thus buoy the device on the molten wax. This device further retains the wick 246 at a predetermined length, which has the advantage that the length of the wick does not change, thus providing a consistent flame size during burning of the candle.

Referring now to FIG. 19, a chimney adapter 250 of the invention adapts the upper portion 174 of the chimney 22 to receive scented oil (not shown) retained in the recess 252 of the saucer 254. The heat generated by the candle 36 heats and diffuses the scented oil into the air. The adapter 250 includes an internal cylindrical surface 256 matched to the outer diameter of the upper portion 174 of the chimney. The exit holes 177 are provided so that the heated air may escape.

Referring now to FIG. 20, an alternate chimney adapter 260 adapts the chimney 22 to receive standard scented oil receptacles 262 for scent diffusion. Referring now to FIG. 21, an alternate chimney 22' includes an integrated receptacle 264 for scented oil. Referring now to FIG. 22, a second alternate chimney 22" is adapted to receive a standard scented oil receptacle 262 to cover opening 175'. Air exhaust holes 177 permit the hot exhaust air to escape, despite the fact that the receptacle 262 otherwise blocks the opening 175'.

Note as well that a fan-like structure (not shown) could be held in place within the chimney, such as by suspending from the upper portion 174 (via a hook over the lip around the hole 175). The rising air in the chimney 22 would activate turning of the fan, to provide a further visual effect. Such fan could be made up of veins with reflective surfaces which would cause the reflection of light spots on walls which would turn, much like a disco ball. In an advantage, the invention provides a source of light and heat, or a visual stimulus which is desirable and unique.

Figure 23:
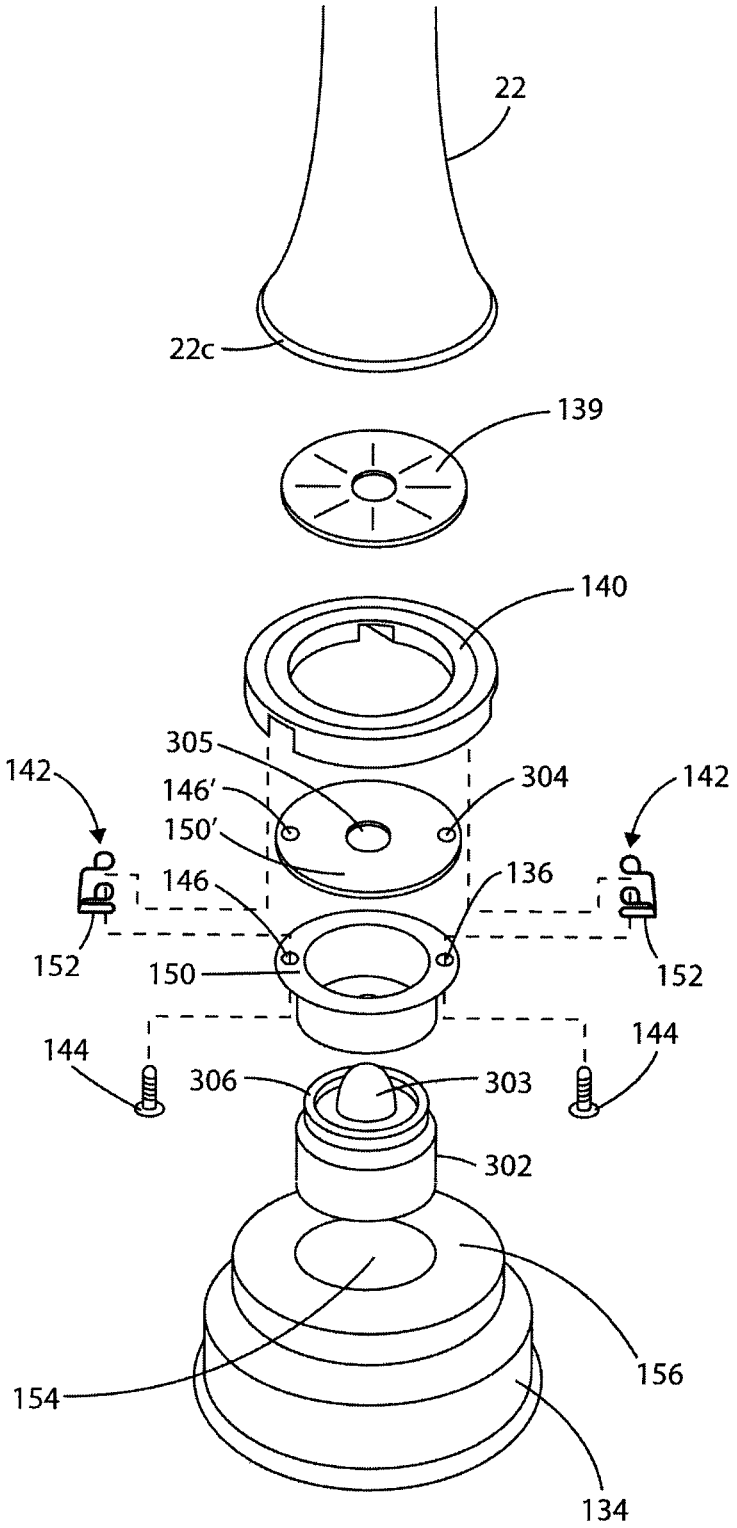
FIG. 23 is a perspective, exploded view of a lamp oil version of the invention.

Referring now to FIG. 23, the invention is embodied as an oil lamp 300 in which the lamp oil is encased in a separable container 302 (shown here with a plastic cover 303 which must be removed before assembly is permitted through the hole 306, and certainly before ignition) which is preferably disposable. This embodiment is substantially identical to the embodiment for a tealight, shown in FIG. 11, among others. The only changes necessary to adapt the version of FIG. 11 to this new embodiment is the form of the candle cup (now liner) 136' (the liner surrounds the outside of the container 302) in that the bottom of the candle cup 136 is removed so that the outer diameter of the container 302 may pass therethrough and be centered thereby) and the addition of a cover 304. The cover 304 is disposed between the manifold 140 and the candle cup 136' and held in place by the fasteners 144. The cover 304 is a thin, round washer formed with a hole 305 through which the stem (not shown) of the container 302 may pass. The stem includes the wick which passes through the hole 305 until a rim 306 abuts the bottom surface of the cover 304, and so is lit from above. The cover 304 is preferably highly polished (a mirror finish is preferable) on the top surface 150' thereof so as to reflect the light emitted by the flame and thus to create a mirror image thereof which turns therewith. The polished cover further serves to divert the heat generated by the flame upwardly out of the chimney 22.

Optionally, a decorative ring 139 may be placed on the cover 304. This ring 139 may be made of crystal, in order to benefit from the mirrored surface of the cover 305, or may be of any other material, for example, anodized and etched or engraved aluminum, or gold, silver etc. The decorate ring 139 may be embossed (stamped) with a pattern so that it is no longer completely flat, such that the lower surface does not sit flat against the cover 305. This allows oil which leaches out of the wick to be concealed. Alternatively, instead of a boss, small feet or standoffs may be formed on the lower surface of the ring 139. These feet (not shown) may also be bent down portions of the ring, along its periphery, or stamped dimples formed downwardly, so as to have the same effect of lifting the ring 139 above the surface of the cover 304 in order to protect against seepage of oil on the top surface of the ring 139.

A suitable container 302 is available from Hollowick, Inc, of New York, under their model number HD8, which is sized to the dimensions of a common tealight candle.

The above-described embodiment further has the advantage that the position of the flame does not change as the lamp burns, thus ensuring a consistent presentation. The oil used may also be selected among oils that generate almost no soot or CO2 emissions. Still further, the container 302 is non spill, thereby permitting movement or displacement of the lamp 300 without creating a wax mess as may be the case with the version of FIG. 11. This also results in a lamp 300 which can be placed on inclined surfaces while still functioning and without the risk of leakage or spillage. Therefore, fully functional positioning of the lamp 300 on uneven surfaces which is typical in ancient cathedrals and window sills or alters of chapels which have settled over the years is facilitated. Further, placement of the lamp 300 at an incline may promote better viewing of the flame, depending on the relative position of the viewer to the lamp.

A further advantage is gained when sufficient play (approximately 1 mm on an overall hole diameter of 40 mm) is allowed between the liner 136' and the hole 154 in the lower base 134. This allows the chimney 22 and metal subassembly (made up of components 140, 304, 136 and 152, fastened together with fasteners 144, in an integral assembly), firmly held together by the retainer springs 152 acting against the rim of the chimney 22, to tilt together laterally when laterally biased from above, near for example, the air inlet 22' (by for example an inadvertent contact with an object). This tilting lifts the cover 304 and thus its hole 305 over the burning wick, which deprives the burning wick of sufficient oxygen and automatically extinguishes the flame, resulting in an extremely safe oil lamp, as, in addition to this automatic extinguishing feature, the flame is enclosed with the glass chimney safely away from nearby or adjacent combustible objects such as curtains. In fact, a curtain which might inadvertently cover the glass chimney 22 would also extinguish the flame without tilting of the chimney and metal subassembly, due to the upper air outlet 175 being blocked, so as to deprive the flame of oxygen.

The candle holder 10 or lamp 300 operates best when the tealight 200 or oil container 302 used is selected for optimum combustion. Biomass wax is preferred and results in cleaner burning, lower temperatures, and a consistent flame.

Figure 24:
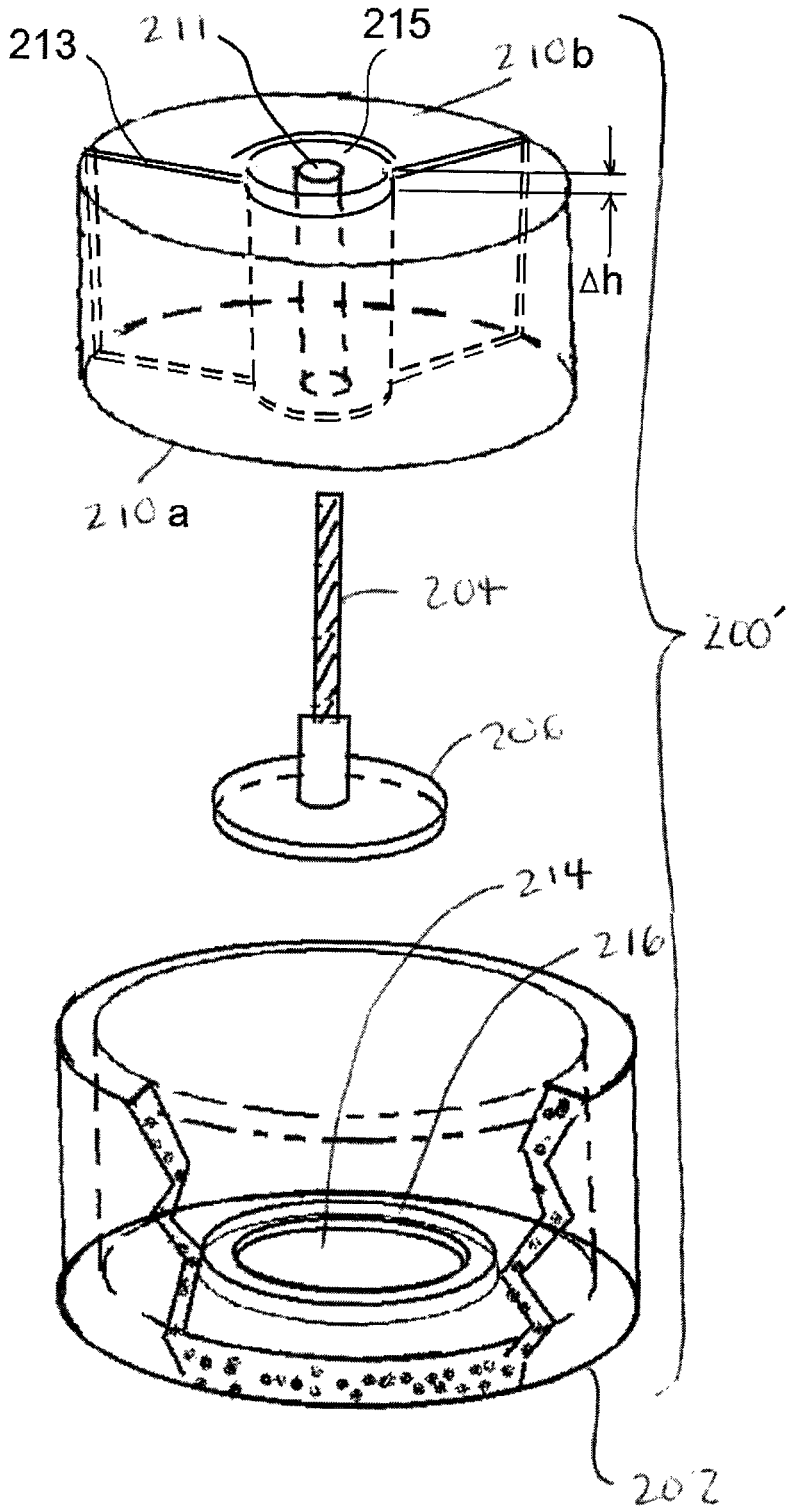
FIG. 24 is a perspective view of an alternate tealight for use with the invention.

Referring now to FIG. 24, a tealight assembly 200' of the invention allows a variety of possible compositions for use with this or any candle holder. In this embodiment, one wax portion 210*a* (molded to a desired shape) combines with another wax portion 210*b* (molded to a complimentary shape) with a wick of any width, composition, and length placed therebetween, to allow a candle manufacturer or a user to easily assemble the composite tealight having desired or selected characteristics. For example, not only can different types of fuels be readily matched or mated one to the other, such as biomass and paraffin (or palm oil, etc), in addition, different scents can be mixed such as apples and cinnamon, or colored waxes, such as red and white. Swirling color effects may also be generated thereby. This embodiment thus provides a wider range of scent and composition choices and allows ready experimentation with such compositions. It should be noted that a binding wax (not shown) may be applied over the portions 210*a* and 210*b* to hold them together and to fill in any gaps 213 between such portions.

The embodiment is shown with a hole 211 through the portion 210*b* because it has been noted through experimentation that where the wick is simply placed between two adjacent portions (such as in the gaps 213 between portions 210*a* and 210*b*), and lit, the wick 204 burns down below the top surface and once sufficient wax has melted to fill the gaps, it can drown out the wick and extinguish the flame. When the wick 204 is placed in a narrow hole 211 as shown, there are fewer problems with self extinguishing. However, in this embodiment, where the wick 204 is simply placed between the portions 210*a* and 210*b*, the portions can include a boss or raised ridge around the wick 204 (or a separate washer formed wax ridge (optionally conical in form, so that the apex surrounds the wick) placed around the wick to prevent excessive burn down), to compensate for the amount of burn down prior to there being enough fluid wax to supply the wick for continuing burning. Alternatively, the upper surfaces of each portion can be conical with the apex around the wick 204. In this way, a wax dam 215 is placed around the wick 204 of a wax volume selected such that when it melts, the melted wax of the wax dam fills up the gaps 213 between the adjacent portions 210*a* and 210*b*, before the flame has a chance to burn to a level below the upper surface. Alternatively, the portion 210*a* may be made with a lower height, delta h, than portion 210*b*, such that the volume of wax associated with the additional height of the portion 210*b* comprises enough wax to fill the gaps 213 between the portions before the wick burns down to a point where there is little or no risk of self-extinguishing.

Figure 25:
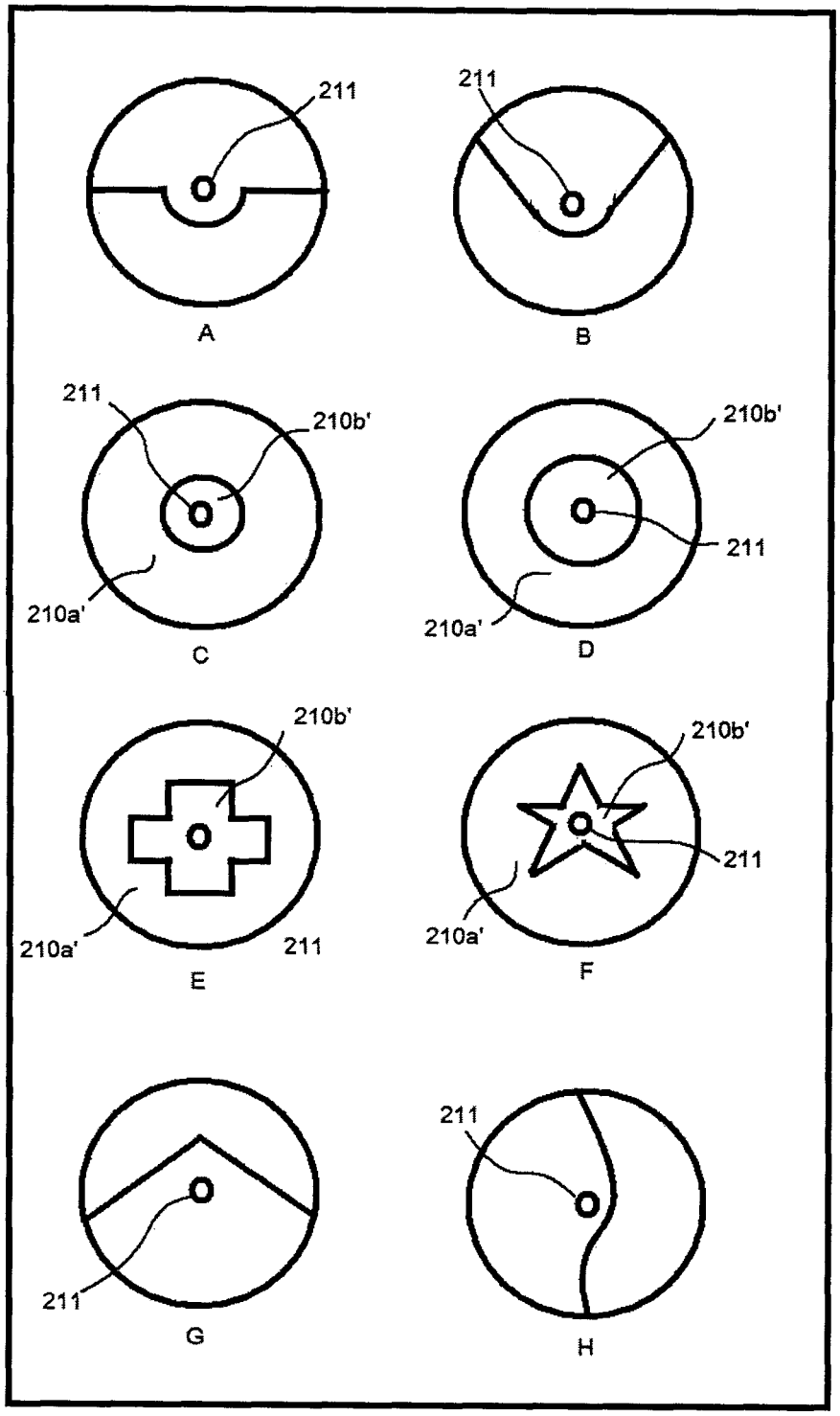
FIG. 25 is a table of possible forms of the alternate tealight of FIG. 24.

Referring now to FIG. 25, the shape of the portions 210*a* and 210*b* may take on any complimentary form from the pie shape to a teardrop form and thus offers an infinite variety of interfacing combinations. Further, more than two portions may be used. For example, three portions may be combined to create a single composite tealight assembly, thereby permitting still further variation. Alternatively, the portions 210*a*' and 210*b*' may be installed concentrically, as shown in FIG. 25, sub-embodiments C, D, E and F. This embodiment permits the use of a more volatile fuel immediately around the wick (e.g., portion 210*b*'), for quick burning and melting of the surrounding wax, which may be less volatile, thereby quickly reducing the intensity of the flame and therefore the associated heat generated thereby. Such an embodiment may advantageously be used to promote ignition of the flame in a windy environment, or to provide time to apply the chimney 22 before wind blows the flame out. In another advantage, the invention provides a light spiel which is unique and which requires no batteries or other energy inputs other than the burning fuel of the heat source, which typically is a simple candle.

Figure 26:
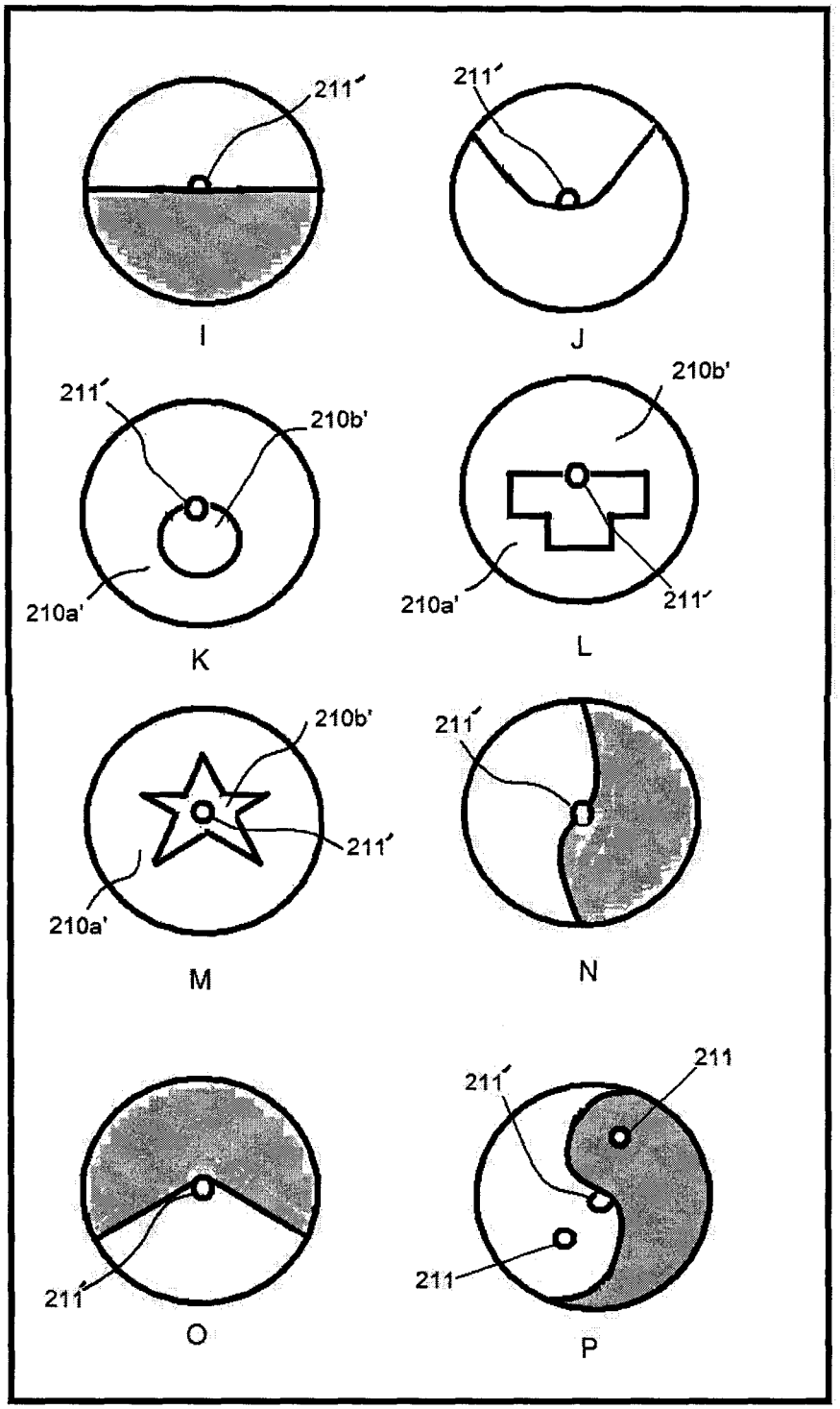
FIG. 26 is a further table of possible forms of an alternate tealight

Referring to FIG. 26, embodiments I to P are shown where the wick 204 is placed in a recess 211' between adjacent portions 210*a* and 210*b*. Embodiment P (a ying-yang form) may have one wick in a recess 211' between the two forms or two wicks, one in each hole 211 of each portion 210*a* and 210*b*. Note that for the embodiments A-H and P, the wick may be preinstalled as in a normal candle. The embodiments C and D essentially are a small candle which is surrounded by a ring of another wax composition or color or scent.

In another advantage, the fireplace embodiment of the invention provides a way to maximize convective heat transfer to the chimney portion of the invention, thereby extracting more heat from the invention than prior art devices.

In another advantage, despite the almost direct contact of the glass portion 22 with the flame, the glass does not become darkened by soot.

In another advantage, the device is modular and easy to assemble.

In another advantage, using various restrictors, or not using one, controls the speed of rotation of the flame.

In another advantage, the speed of rotation of the flame can be infinitely adjustable.

In another advantage, the wick centering devices center the wick and therefore keep the flame in an optimal position for being turned by the air which is drawn into the chamber.

In another advantage, the wick centering devices rotate with the flow of wax and provide a further interesting visual effect.

In another advantage, the wick centering device which includes the wick, prevents the wick length from increasing so as to create a flame which is proportionally too large for the chamber, and further minimizes soot generation.

In another advantage, the turning and liquification of the wax provides a support for glitter or for wax of another color or other suspended particles, which provide a further interesting visual effect.

In another advantage, the rate of rotation of the flame can be controlled by the candle itself, by tabs which block or partially block an inlet.

In another advantage, a centering ridge in the base of the candle cup helps prevent the wick from moving off center.

In another advantage, a receptacle receives a fragrant oil for heating and atomizing into the environment.

In another advantage, the receptacle is adapted to be placed over a standard chimney.

In another advantage, the receptacle is adapted to provide a support for a standard heated oil dish.

In an advantage, a composite tealight allows easy selection of waxes and or scents to suit a user's specific needs or tastes.

It should be noted that the Carioles force effects the rotation of swirling gases in the chamber 16. However, the effect of this force is believed to be negligible, thereby allowing the invention to be designed either with a rightward or a left-handed rotation, with or against the Coriolis acceleration forces. However, movement with the Carioles force would be preferred.

In the foregoing specification, the invention has been described with reference to specific exemplary embodiments; however, it will be appreciated that various modifications and changes may be made without departing from the scope of the present invention as set forth in the claims below. The specification and figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above. For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components of any or all the claims.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted by those skilled in the art to specific environments, manufacturing specifications, design parameters or other operating requirements without departing from the general principles of the same.

The patents and articles mentioned above are hereby incorporated by reference herein, unless otherwise noted, to the extent that the same are not inconsistent with this disclosure.

Other characteristics and modes of execution of the invention are described in the appended claims.

Further, the invention should be considered as comprising all possible combinations of every feature described in the instant specification, appended claims, and/or drawing figures which may be considered new, inventive and industrially applicable.

Multiple variations and modifications are possible in the embodiments of the invention described here. Although certain illustrative embodiments of the invention have been shown and described here, a wide range of modifications, changes, and substitutions is contemplated in the foregoing disclosure. While the above description contains many specifics, these should not be construed as limitations on the scope of the invention, but rather as exemplifications of one or another preferred embodiment thereof. In some instances, some features of the present invention may be employed without a corresponding use of the other features. Accordingly, it is appropriate that the foregoing description be construed broadly and understood as being given by way of illustration and example only, the spirit and scope of the invention being limited only by the claims which ultimately issue in this application.

What is claimed is:

1. Apparatus for containing a heat source (36) in a chamber (16) having a chimney-section (22), the apparatus having a gas inlet opening (24, 26, 30) and a gas outlet opening (32), the gas outlet opening (32) being formed in the chimney-section (22), wherein the gas inlet opening (24, 26, 30) and the heat source are located in a lower area (12, 20') of the chamber (16) and the gas outlet opening (32) is located in an upper region (14) of the chamber (16) so that, when a heat source is placed in the chamber (16), an ascending gas flow may be generated in the chamber (16), wherein inflowing gas flows into the lower area (12, 20') of the chamber (16) and then is drawn upwardly by a draw of the ascending gas flow and then though the gas outlet opening (32), wherein further, the apparatus includes a subassembly (27) includes an air flow guide (140), clips (142), a cover (304) with a centering hole (305) and a liner (136), the cover (304) connected to the subassembly (27) via the clips (142), the liner (136) having a lower end adapted to contain a container (302) enclosing a combustible liquid and having a wick (307), wherein the centering hole (305) is adapted to allow the wick (307) to pass therethrough, and wherein the chimney-section (22) is attached to the subassembly (27) so that lateral tilting of the chimney-section (22) causes motion of the subassembly (27) relative to the wick (307).

2. The apparatus of claim 1, wherein the liner is guided in rotation about the central axis by its cylindrical form and guided or restricted in rotational motion about the central axis by an adjacent cylindrical surface of the apparatus.

3. The apparatus of claim 1, wherein the liner is supported in its vertical position by a support surface of the apparatus.

4. The apparatus of claim 1, wherein the liner has a grippable surface facilitating rotational displacement of the liner.

5. The apparatus of claim 4, wherein the grippable surface projects from the liner.

6. The apparatus of claim 5, wherein the liner is centrally disposed between the heat source and an inlet.

7. The apparatus of claim 1, wherein the gas outlet opening (32) includes a flow restrictor (170, 180, 260) which restricts flow of exit gases.

8. The apparatus of claim 7, wherein the restrictor (180) is a valve.

9. The apparatus of claim 7, wherein the restrictor (170, 180, 260) is held in place by its own weight.

10. The apparatus of claim 7, wherein the restrictor (250, 260) supports and heats a scented oil receptacle (262).

11. The apparatus of claim 10, wherein the restrictor (250) is integrally formed with the scented oil receptacle (254), providing alternate air exhaust holes (177) permitting air to escape while heating the receptacle.

12. A tealight candle for use with the apparatus of claim 1, characterized in that the blocking portion are tabs (222) formed on a liner (220) into which the tealight is disposed, the liner being rotatably displaceable about the central axis of the apparatus.

13. The tealight candle of claim 1, wherein the liner is disposable.

* * * * *